US011823639B2

(12) United States Patent
Lu et al.

(10) Patent No.: US 11,823,639 B2
(45) Date of Patent: Nov. 21, 2023

(54) DRIVING CIRCUIT, MULTI-STAGE DRIVING CIRCUIT AND DISPLAY PANEL

(71) Applicant: HKC CORPORATION LIMITED, Shenzhen (CN)

(72) Inventors: Zhaoyang Lu, Shenzhen (CN); Byung Hoon Kim, Shenzhen (CN); Rongrong Li, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/877,609

(22) Filed: Jul. 29, 2022

(65) Prior Publication Data

US 2023/0036780 A1 Feb. 2, 2023

(30) Foreign Application Priority Data

Jul. 30, 2021 (CN) ..... 202110879240.3

(51) Int. Cl.
*G09G 3/36* (2006.01)

(52) U.S. Cl.
CPC ... *G09G 3/3655* (2013.01); *G09G 2300/0814* (2013.01); *G09G 2300/0852* (2013.01); *G09G 2310/061* (2013.01); *G09G 2310/08* (2013.01)

(58) Field of Classification Search
CPC ..... G09G 3/3655; G09G 2300/0814; G09G 2300/0852; G09G 2310/061; G09G 2310/08
See application file for complete search history.

(56) References Cited

U.S. PATENT DOCUMENTS

2019/0311691 A1* 10/2019 Feng ..... G09G 3/36

FOREIGN PATENT DOCUMENTS

| | | | |
|---|---|---|---|
| CN | 205564249 | U | 9/2016 |
| CN | 106531053 | A | 3/2017 |
| CN | 106652936 | A | 5/2017 |
| CN | 108492793 | A | 9/2018 |
| CN | 112908235 | A | 6/2021 |

OTHER PUBLICATIONS

First Office Action issued in counterpart Chinese Patent Application No. 202110879240.3, dated Oct. 9, 2022.

* cited by examiner

*Primary Examiner* — Robert J Michaud
(74) *Attorney, Agent, or Firm* — Westbridge IP LLC

(57) ABSTRACT

Disclosed are a driving circuit, a multi-stage driving circuit and a display panel. The driving circuit includes an input circuit, a pull-down circuit and an output circuit. The output circuit includes at least two sub-output circuits, the control terminals of the two adjacent sub-output circuits are connected through at least one isolation switch. Each sub-output circuit receives a control signal and a corresponding input signal output by the input circuit and outputs a corresponding output signal. An output terminal of each sub-output circuit is connected with the pull-down circuit and receives a pull-down signal. By arranging the isolating switch between the adjacent sub-output circuits, the mutual influence between the sub-output circuits is reduced, the problem that the output signal is abnormal is solved, the output signal is more stable on the basis of narrowing the frame of a display, and the competitiveness of the display is improved.

13 Claims, 9 Drawing Sheets

DRIVING CIRCUIT, MULTI-STAGE DRIVING CIRCUIT AND DISPLAY PANEL

CROSS-REFERENCE TO RELATED APPLICATIONS

This application claims priority to Chinese Patent Application No. 202110879240.3, filed on Jul. 30, 2021. The disclosures of the aforementioned application are incorporated in this application by reference in its entirety.

TECHNICAL FIELD

The present application relates to the field of display, and in particular, to a driving circuit, a multi-stage driving circuit and a display panel.

BACKGROUND

The liquid crystal display has been used widely for it's numerous advantages such as thin body, power saving, no radiation and the like. With the improvement of the living, people have higher requirements, such as lower price and narrower bezel, etc. on the display products.

At present, in order to reduce the product cost, the array substrate type driving technology is usually adopted in the manufacturing process. The traditional gate driving chip is abandoned, instead, the gate driving circuit is directly formed on the glass substrate of the display panel. Therefore, the two sides of the display panel do not need to be driven by a chip, and the product cost is greatly reduced.

To pursue a smooth driving effect of the common array substrate type driving technology, the shared quiescent point of the output circuits is usually pre-charged to achieve a high voltage level, which can be coupled with the subsequent clock signal to obtain an ideal signal waveform, thus when the switches of the thin film transistors are turned on, the gate scanning signal required by the gate lines can be smoothly transmitted. However, sharing the quiescent point is easy to cause an excessive voltage at quiescent point due to two times of voltage pulling up during the high voltage writing phase of the clock signal of the output circuits, which causes the thin film transistors connected to the quiescent point to be damaged, and the output signal waveform thereof abnormal. The whole circuit is thereby affected.

The above content is only used to assist in understanding the technical solution of the present application, and it does not represent an admission that the above-mentioned content is prior art.

SUMMARY

The main object of the present application is to provide a driving circuit, a multi-stage driving circuit and a display panel, and aims to solve the problem that the output signals are abnormal due to that the output circuits share a quiescent point.

In order to achieve the above objective, the present disclosure provides a driving circuit including:

an input circuit configured to output a control signal upon receiving a trigger signal, an output circuit including at least two sub-output circuits, where a control terminal of a first sub-output circuit of the output circuit is connected to an output terminal of the input circuit, and control terminals of two adjacent sub-output circuits are connected by at least one isolation switch, each sub-output circuit is configured to receive a corresponding input signal and output a corresponding output signal according to the control signal and the corresponding input signal;

the at least one isolation switch configured to establish a connection between the control terminals of the two adjacent sub-output circuits upon receiving a turn-on signal, and cut off the connection between the control terminals of the two adjacent sub-output circuits upon receiving a turn-off signal;

a pull-down circuit having a first terminal connected to the output terminal of the input circuit and an output terminal of each sub-output circuit, and a second terminal connected to a low level voltage, and the pull-down circuit being configured to pull down the control signal and the corresponding output signal of each sub-output circuit to a low level when a pull-down control signal is at a high level, and stop pulling down the control signal and the corresponding output signal of each sub-output circuit when the trigger signal or the control signal is at the high level.

In an embodiment the driving circuit further includes a cascading down circuit, a control terminal of the cascading down circuit is connected to the output terminal of the input circuit, and configured to output a cascading down signal upon receiving a first input signal and the control signal.

In an embodiment the driving circuit further includes a reset circuit, a control terminal of the reset circuit is configured to receive a reset signal, an input terminal of the reset circuit is connected to the output terminal of the input circuit, and an output terminal of the reset circuit is connected to a first low level voltage.

In an embodiment the output circuit includes a first sub-output circuit and a second sub-output circuit, and the isolation switch includes a first isolation switch, a control terminal of the first sub-output circuit is connected to the output terminal of the input circuit and a control terminal of the first isolation switch, and a second terminal of the isolation switch is connected to a control terminal of the second sub-output circuit, an input terminal of the first sub-output circuit is configured to receive a first input signal, and an output terminal of the first sub-output circuit is configured to output a first output signal; and an input terminal of the second sub-output circuit is configured to receive a second input signal, and an output terminal of the second sub-output circuit is configured to output a second output signal.

In an embodiment the first isolation switch includes an isolation switching transistor, a control terminal of the isolation switching transistor is configured to receive an isolation signal, an input terminal of the isolation switching transistor is connected to the control terminal of the first sub-output circuit, and an output terminal of the isolation switching transistor is connected to the control terminal of the second sub-output circuit.

In an embodiment the pull-down circuit includes a pull-down holding circuit and a pull-down sub-circuit, an input terminal of the pull-down holding circuit is connected to the output terminal of the input circuit, and the pull-down holding circuit is configured to output a pull-down signal according to the pull-down control signal, a voltage of the pull-down signal is pulled down according to the trigger signal and the control signal; a control terminal of the pull-down sub-circuit is connected to an output terminal of the pull-down holding circuit, an input terminal of the pull-down sub-circuit is connected to the output terminal of the input circuit, the output terminal of the first sub-output circuit and the output terminal of the second sub-output circuit, and an output terminal of the pull-down sub-circuit is connected to a first low level voltage, and the pull-down sub-circuit is configured to pull the first output signal of the first sub-output circuit and the second output signal of the second sub-output circuit to the low level upon receiving the pull-down signal.

The pull-down sub-circuit includes a first switching transistor, a second switching transistor, and a third switching transistor.

A control terminal of the first switching transistor is configured to receive the pull-down signal, an input terminal of the first switching transistor is connected to the output terminal of the input circuit, and an output terminal of the first switching transistor is connected to the first low level voltage.

A control terminal of the second switching transistor is configured to receive the pull-down signal, an input terminal of the second switching transistor is connected to the output terminal of the first sub-output circuit, and an output terminal of the second switching transistor is connected to a second low level voltage.

A control terminal of the third switching transistor is configured to receive the pull-down signal, an input terminal of the third switching transistor is connected to the output terminal of the second sub-output circuit, and an output terminal of the third switching transistor is connected to the second low level voltage.

In an embodiment the pull-down sub-circuit further includes a fourth switching transistor, a control terminal of the fourth switching transistor is configured to receive the pull-down signal, an input terminal of the fourth switching transistor is connected to an output terminal of the cascading down circuit, and an output terminal of the fourth switching transistor is connected to the first low level voltage.

In addition, in order to achieve the above object, the present application further provides a multi-stage driving circuit, including a first driving circuit and a second driving circuit, the first driving circuit includes:

a first input circuit configured to output a first control signal upon receiving a first trigger signal;

a first output circuit including at least two first sub-output circuits, where a control terminal of a first one of the at least two first sub-output circuit of the first output circuit is connected to an output terminal of the first input circuit, and control terminals of two adjacent first sub-output circuits are connected by at least one first isolation switch, where each first sub-output circuit is configured to receive a corresponding input signal and output a corresponding output signal according to the control signal and the corresponding input signal;

the at least one first isolation switch configured to establish a connection between the control terminals of the two adjacent first sub-output circuits upon receiving a first turn-on signal, and cut off the connection between the control terminals of the two adjacent first sub-output circuits upon receiving a first turn-off signal;

a first pull-down circuit having a first terminal connected to the output terminal of the first input circuit and an output terminal of each first sub-output circuit, and a second terminal connected to a low level voltage, and the first pull-down circuit being configured to pull down the first control signal and the corresponding output signal of each first sub-output circuit to a low level when a first pull-down control signal is at a high level, and stop pulling down the first control signal and the corresponding output signal of each first sub-output circuit when the first trigger signal or the first control signal is at the high level; and the second driving circuit includes:

a second input circuit configured to output a second control signal upon receiving a second trigger signal;

a second output circuit including at least two second sub-output circuits, where a control terminal of a first one of the at least two second sub-output circuit of the second output circuit is connected to an output terminal of the second input circuit, and control terminals of two adjacent second sub-output circuits are connected by at least one second isolation switch, where each second sub-output circuit is configured to receive a corresponding input signal and output a corresponding output signal according to the control signal and the corresponding input signal;

the at least one second isolation switch configured to establish a connection between the control terminals of the two adjacent second sub-output circuits upon receiving a second turn-on signal, and cut off the connection between the control terminals of the two adjacent second sub-output circuits upon receiving a second turn-off signal;

a second pull-down circuit having a first terminal connected to the output terminal of the second input circuit and an output terminal of each second sub-output circuit, and a second terminal connected to the low level voltage, and the second pull-down circuit being configured to pull down the second control signal and the corresponding output signal of each second sub-output circuit to the low level when a second pull-down control signal is at the high level, and stop pulling down the second control signal and the corresponding output signal of each second sub-output circuit when the second trigger signal, the first control signal or the second control signal is at the high level, a voltage level of the first pull-down control signal is opposite to a voltage level of the second pull-down control signal.

In addition, in order to achieve the above object, the present application further provides a display panel including a display area and a non-display area, a plurality of pixel units are arranged on the non-display area, and the display panel further includes:

a driving circuit disposed on the non-display area to output a driving signal to drive the plurality of pixel units, where the driving circuit is the driving circuit described above; or a multi-stage driving circuit arranged on the non-display area to output a driving signal to drive the plurality of pixel units, where the multi-stage driving circuit is the multi-stage driving circuit described above.

The present disclosure provides a driving circuit, a multi-stage driving circuit, and a display panel. The driving circuit includes an input circuit, a pull-down circuit and an output circuit. The output circuit includes at least two sub-output circuits. A control terminal of the first sub-output circuit is connected to an output terminal of the input circuit, and control terminals of the other sub-output circuits are connected to the output terminal of the input circuit through at least one isolation switch. Each sub-output circuit receives a control signal output by the input circuit and a corresponding input signal, and outputs a corresponding output signal. An output terminal of each sub-output circuit is connected to the pull-down circuit and receives a pull-down signal. Thus one input signal can output multi stages of driving signals, and compared with the existing one stage driving circuit which can only output one stage driving signal, the numbers of the input circuits and the pull-down circuits are reduced, so that the number of the used components is reduced, the mutual influence between the sub-output circuits is reduced by arranging the isolation switch between the adjacent sub-output circuits, the problem that the output signals are abnormal is solved, and the output signals are more stable on the basis of narrowing the frame of the display product.

BRIEF DESCRIPTION OF THE DRAWINGS

In order to more clearly explain the embodiments of the present application or of the related art, the drawings used in the description of the embodiments or the related art will be briefly introduced below. Obviously, the drawings in the following description are merely some embodiments of the present application. For those of ordinary skill in the art, other drawings can be obtained based on the structure shown in these drawings without creative work.

Figure 1:
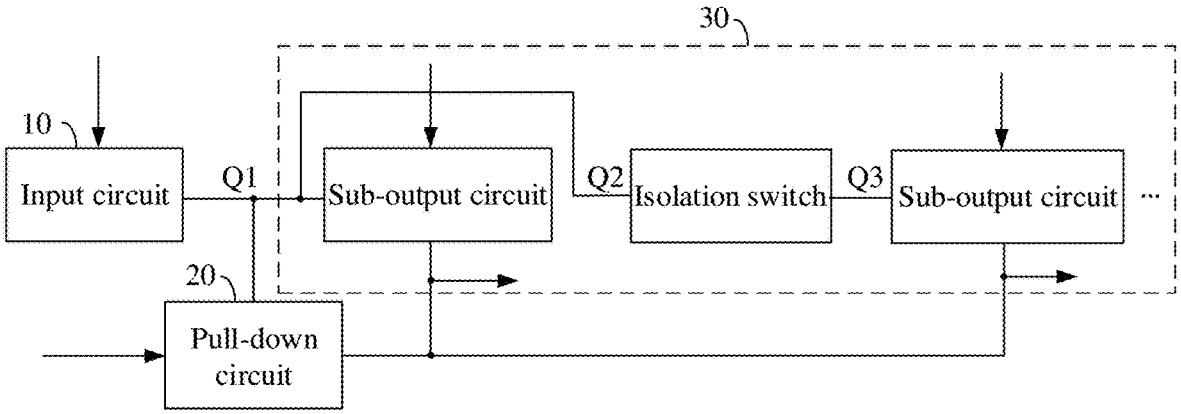
FIG. 1 is a schematic block diagram of a driving circuit according to an embodiment of the present disclosure.

The realization of the purposes, functional features and advantages of the present application will be further explained with reference to the accompanying drawings in combination with the embodiments.

DETAILED DESCRIPTION OF THE EMBODIMENTS

It should be understood that the specific embodiments described herein are merely used to explain the present disclosure, and are not intended to limit the present disclosure.

In the following, the embodiments of the present application will be clearly and completely described with reference to the drawings in the embodiments of the present application. Obviously, the described embodiments are only some of the embodiments of the present application, and not all of the embodiments. Based on the embodiments of the present application, all other embodiments obtained by those of ordinary skilled in the art without creative efforts shall fall within the claimed scope of the present application.

It should be noted that all directional indicators (such as up, down, left, right, front, back, etc.) in the embodiments of the present application are only used to explain the relative positional relationship, movement situation, etc. between components in a specific posture (as shown in the drawings). If the specific posture changes, the directional indication changes accordingly.

In addition, the descriptions related to "first," "second" and the like in the present application are for descriptive purposes only, and should not be understood as indicating or implying their relative importance or implicitly indicating the number of technical features indicated. Therefore, a feature defined by "first" and "second" may explicitly or implicitly include at least one of such feature. In addition, the meaning of "and/or" in the full text includes three parallel solutions, taking "A and/or B" as an example, it includes solution A, solution B, or both solutions A and B. The various embodiments can be combined with each other, but the combination must be based on what can be achieved by those of ordinary skill in the art. When the combination of the embodiments is contradictory or cannot be achieved, it should be considered that such a combination does not exist, or is not within the scope of the claims of the present application.

In the existing array substrate-type driving technology, the manner that two output circuits share a quiescent point is generally adopt, however during the high-voltage writing phase of the input clock signals of two output circuits, an excessive voltage is easily appear at the common quiescent point due to two times of voltage pulling up, and the voltage at the quiescent point may reach 90 V in the simulation experiment test. Thus, the Thin Film Transistors (TFTs) of the gates, which are connected to the quiescent point, are damaged by the high voltage, and the output waveforms are abnormal, which affects the whole circuit.

Based on the above phenomenon, the present disclosure provides a driving circuit. Referring to FIG. 1, in an embodiment, the driving circuit includes an input circuit 10, a pull-down circuit 20, and an output circuit 30.

The output circuit 30 includes at least two sub-output circuits, control terminals of two adjacent sub-output circuits are connected by at least one isolation switch, a first terminal of the pull-down circuit 20 is connected to an output terminal of the input circuit 10 and an output terminal of each sub-output circuit, and a second terminal of the pull-down circuit 20 is connected to a low level voltage.

The input circuit 10 is configured to output a control signal upon receiving a trigger signal.

The isolation switch is configured to establish a connection between control terminals of adjacent sub-output circuits upon receiving a turn-on signal, and disconnect the connection between the control terminals of the adjacent sub-output circuits upon receiving a turn-off signal.

A control terminal of a first sub-output circuit of the output circuit is connected to the output terminal of the input circuit 10, and each sub-output circuit is configured to receive a corresponding input signal, and output a corresponding output signal according to the control signal and the corresponding input signal.

The pull-down circuit 20 is configured to pull down the control signal and the output signal of each sub-output circuit to a low level when a pull-down control signal is at a high level, and stop pulling down the control signal and the output signal of each sub-output circuit when the trigger signal or the control signal is at the high level.

In this embodiment, the trigger signal may be received by the input circuit 10, and the control signal is output accordingly by the input circuit 10. The control terminal of the first sub-output circuit is connected to the output terminal of the input circuit 10 through the point Q1 to receive the control signal. When the isolation switch receives the turn-on signal, the control terminals of the adjacent sub-output circuits are electrically connected with each other, that is, the control terminals of all the other sub-output circuits are electrically connected with the control terminal of the first sub-output circuit, and the control terminals of the other sub-output circuit receives the control signal, thereby each sub-output circuit outputs a corresponding output signal according to the received control signal and the corresponding input signal. The pull-down circuit 20 is configured to pull the control signal and the corresponding output signal of the sub-output circuit to the low level when the pull-down control signal is at the high level. When the trigger signal or the control signal is at the high level, a voltage at the output terminal of the pull-down circuit 20 is pulled down to stop the pull-down circuit 20 from pulling down voltages of the control signal and the output signals of the sub-output circuits.

Figure 2:
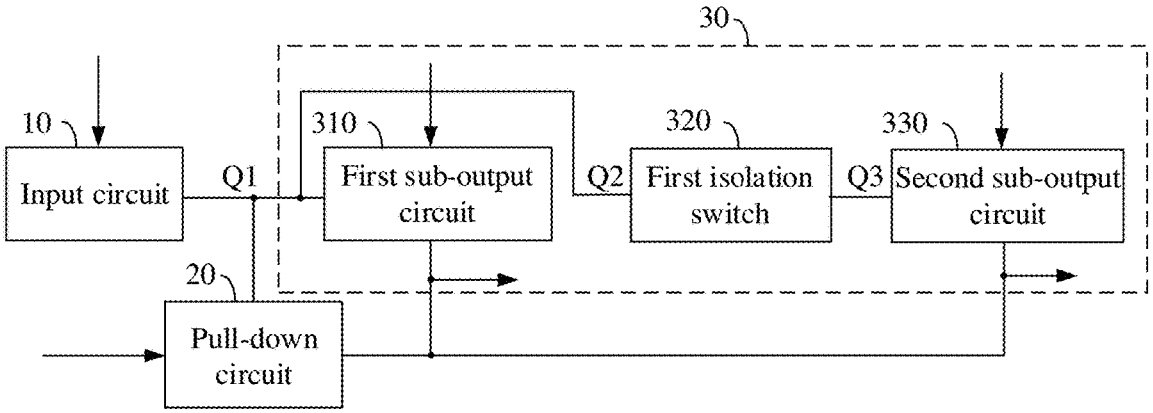
FIG. 2 is a schematic block diagram of the driving circuit according to another embodiment of the present disclosure.

Specifically, referring to FIG. 2, the output circuit 30 includes two sub-output circuits and an isolation switch. The output terminal of the input circuit 10 and the control terminal of the first sub-output circuit 310 are connected to the point Q1. The input circuit 10 receives the trigger signal and outputs the corresponding control signal. The control terminal of the second sub-output circuit 330 is connected to the control terminal of the first sub-output circuit 310. A voltage at a point Q3 is equal to the voltage at the point Q1, and the control terminal of the second sub-output circuit 330 receives the control signal. When the first isolation switch 320 receives the turn-off signal, the connection between the control terminal of the second sub-output circuit 330 and the control terminal of the first sub-output circuit 310 is cut off. The voltage at the point Q3 is isolated from the voltage at the point Q1. The receiving terminal of the first sub-output circuit 310 outputs a first output signal. The receiving terminal of the second sub-output circuit 330 receives a second input signal, and the output terminal of the second sub-output circuit 330 outputs a second output signal. The two sub-output circuits are isolated by the first isolation switch 320, thus the mutual influence between the voltages of the points Q3 and Q1 are reduced, and the waveforms of the first output signal and the second output signal are stabilized.

Figure 3:
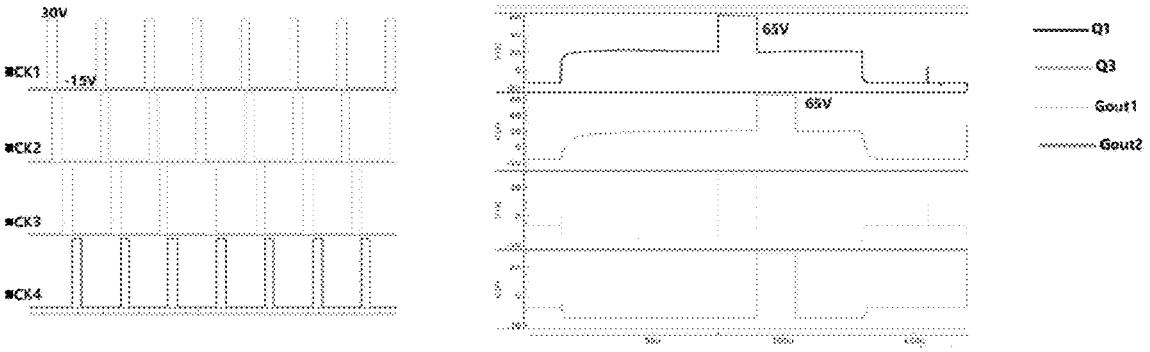
FIG. 3 is a schematic diagram of simulation waveforms according to an embodiment of the present application.

In the present embodiment, by isolating the control terminals of adjacent sub-output circuits through the isolation switch, the mutual influence between the sub-output circuits is reduced. Referring to FIG. 3, under the same simulation condition, during the high-voltage writing phrase of an input clock signal mCK1 of the first sub-input circuit 310 and an input clock signal mCK2 of the second sub-input circuit 330, the voltages at the quiescent points Q1 and Q3 rise to 65 V, which are reduced notably as compared with the 90 V voltage at the common quiescent point in the related art. The deterioration of the TFT due to the high voltage is reduced, and the output signal of the first sub-input circuit 310 and the output signal of the second sub-input circuit 330 are both normal and stable. Thus, the problem of abnormal output signal caused by two stage output circuits sharing the quiescent point is solved. In addition, since the control terminals of the adjacent sub-output circuits are connected to the output terminal of the input circuit 10 through the isolation switch respectively, and receive the control signal output by the input circuit 10 respectively, the output terminals of the sub-output circuit are connected to the pull-down circuit 20 to receive the pull-down signal respectively. In this way, an one-stage driving circuit outputting multi-stage driving signals are realized. The use of a large number of TFTs is avoided, and an area of the driving circuit board is reduced. The output signals are more stable on the basis of narrowing the frame of the display product, the users' requirements are met, and the competitiveness of the product is increased.

Figure 4:
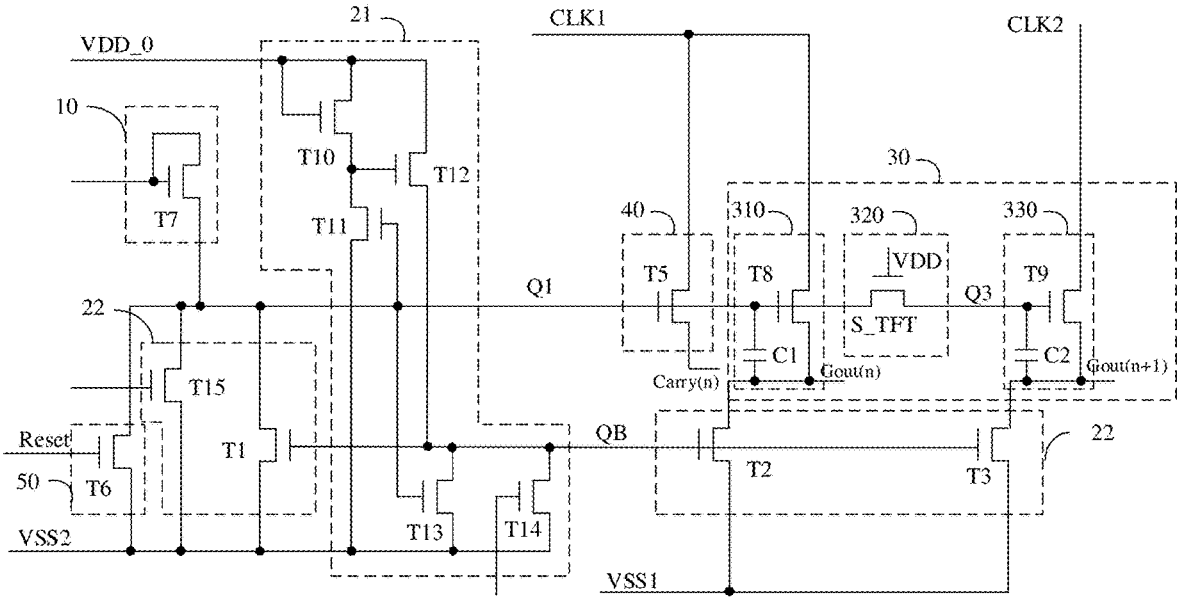
FIG. 4 is a schematic circuit diagram of the driving circuit according to an embodiment of the present disclosure.

Further, referring to FIG. 4, the driving circuit further includes a cascading down circuit 40. A control terminal of the cascading down circuit 40 is connected to the output terminal of the input circuit 10, and configured to output a cascading down signal upon receiving the control signal and the first input signal.

The structure of the cascading down circuit 40 may be set according to actual needs, for example, the cascading down circuit 40 may include a fifth switching transistor T5. A control terminal of the fifth switching transistor T5 is connected to the output terminal of the input circuit 10, an input terminal of the fifth switching transistor T5 is configured to receive the first input signal CLK1, and an output terminal of the fifth switching transistor T5 is configured to output the cascading down signal Carry (n).

Further, the driving circuit further includes a reset circuit 50. A control terminal of the reset circuit 50 is configured to receive a reset signal Reset, an input terminal of the reset circuit 50 is connected to the output terminal of the input circuit 10, and an output terminal of the reset circuit 50 is connected to a first low level voltage VSS2.

In an embodiment, the reset circuit 50 may include a sixth switching transistor T6. A control terminal of the sixth switching transistor T6 is configured to receive a reset signal Reset, an input terminal of the sixth switching transistor T6 is connected to the point Q1, and an output terminal of the sixth switching transistor T6 is connected to the first low level voltage VSS2.

When the reset signal Reset is at the high level, the sixth switching transistor T6 is turned on, and the voltage at the point Q1 is pulled down to the low level.

Further, the structure of the input circuit 10 may be set according to actual needs, for example, the input circuit 10 may include a seventh switching transistor T7. A control terminal of the seventh switching transistor T7 is connected to an input terminal of the seventh switching transistor T7 and configured to receive the trigger signal, an output terminal of the seventh switching transistor T7 is the output terminal of the input circuit 10 and connected to the point Q1.

When the trigger signal is at the high level, the seventh switching transistor T7 is turned on, the control signal is at the high level, and the point Q1 is at the high level.

It should be noted that the switching transistor may be replaced by an equivalent circuit or an independent electronic element, and details are not described herein. Further, a type of the switching transistor may also be set according to actual needs, and the switching transistor may be a TFT.

Further, the output circuit 30 including a first sub-output circuit 310, a second sub-output circuit 330 and a first isolation switch 320 is taken as an example. Referring again to FIG. 2, a control terminal of the first sub-output circuit 310 is connected to the output terminal of the input circuit 10 and a first terminal of the first isolation switch 320, and a second terminal of the first isolation switch 320 is connected to a control terminal of the second sub-output circuit 330. An input terminal of the first sub-output circuit 310 is configured to receive a first input signal, and an output terminal of the first sub-output circuit 310 is configured to output a first output signal. An input terminal of the second sub-output circuit 330 is configured to receive a second input signal, and an output terminal of the second sub-output circuit 330 is configured to output a second output signal.

In an embodiment, referring again to FIG. 4, the first sub-output circuit 310 may include an eighth switching transistor T8 and a first capacitor C1. A control terminal of the eighth switching transistor T8 is connected to the point Q1, an input terminal of the eighth switching transistor T8 is configured to receive a first input signal CLK1, and an output terminal of the eighth switching transistor T8 is configured to output a first output signal Gout(n). One terminal of the first capacitor C1 is connected to the control terminal of the eighth switching transistor T8, and the other terminal of the first capacitor C1 is connected to the output terminal of the eighth switching transistor T8.

The second sub-output circuit 330 may include a ninth switching transistor T9 and a second capacitor C2. A control terminal of the ninth switching transistor T9 is connected to the second terminal of the first isolation switch 320, an input terminal of the ninth switching transistor T9 is configured to receive a second input signal CLK2, and an output terminal of the ninth switching transistor T9 is configured to output a second output signal Gout(n+1). One terminal of the second capacitor C2 is connected to the control terminal of the ninth switching transistor T9, and the other terminal of the second capacitor C2 is connected to the output terminal of the ninth switching transistor T9.

Further, the first isolation switch 320 includes an isolation switching transistor S_TFT. A control terminal of the isolation switching transistor S_TFT is connected to a high level voltage VDD, a first terminal of the isolation switching transistor S_TFT is connected to the point Q1, and an output terminal of the isolation switching transistor S_TFT is connected to the control terminal of the second sub-output circuit 330.

The control terminal of the eighth switching transistor T8 is connected to the point Q1. When the control signal is at the high level, the point Q1 is also at the high level. The control terminal of the isolation switching transistor S_TFT is connected to the high level voltage VDD. A voltage difference between the gate and the source of the isolation switching transistor S_TFT is greater than a conduction threshold, and the isolation switching transistor S_TFT is turned on. The point Q3 is at the high level, and the source of the isolation switching transistor S_TFT is also at the high level. The voltage difference between the gate and the source is less than the conduction threshold, and the isolation switching transistor S_TFT is turned off. The control terminal of the eighth switching transistor T8 is isolated from the ninth switching transistor T9 by the switching transistor S_TFT. The eighth switching transistor T8 outputs Gout(n) according to the first clock signal CLK1. The ninth switching transistor T 9 outputs Gout(n+1) according to the second clock signal CLK2. The first input signal is the first clock signal CLK1, and the second input signal is the second clock signal CLK2. The first output signal is the driving signal Gout(n), and the second output signal is the driving signal Gout(n+1). The control terminal of the eighth switching transistor T8 is isolated from the control terminal of the ninth switching transistor T9 by the switching transistor S_TFT. The deterioration of the TFT due to the high voltage is alleviated, and thus the corresponding output signal is more stable.

The first capacitor C1 and the second capacitor C2 are mainly configured to maintain the voltage difference between the control terminal and the output terminal of the eighth switching transistor T8 and the voltage difference between the control terminal and the output terminal of the ninth switching transistor T9, to stabilize the output of the eighth switching transistor T8 and the output of the ninth switching transistor T9.

Further, the pull-down circuit 20 includes a pull-down holding circuit 21 and a pull-down sub-circuit 22.

An input terminal of the pull-down holding circuit 21 is connected to the output terminal of the input circuit 10, and the pull-down holding circuit 21 is configured to output a pull-down signal according to the pull-down control signal, and pull down the pull-down signal according to the trigger signal and the control signal.

A control terminal of the pull-down sub-circuit 22 is connected to an output terminal of the pull-down holding circuit 21, and an input terminal of the pull-down sub-circuit 22 is connected to the output terminal of the input circuit 10, the output terminal of the first sub-output circuit 310 and the output terminal of the second sub-output circuit 330. An output terminal of the pull-down sub-circuit 22 is connected to the first low level voltage VSS2, and configured to pull the control signal, the first output signal Gout(n) and the second output signal Gout(n+1) to the low level upon receiving the pull-down signal.

Further, the pull-down holding circuit 21 includes a tenth switching transistor T10, an eleventh switching transistor T11, a twelfth switching transistor T12, a thirteenth switching transistor T13, and a fourteenth switching transistor T14.

A control terminal of the tenth switching transistor T10 is connected to the input terminal of the tenth switching transistor T10 and configured to receive the pull-down control signal VDD_0, an output terminal of the tenth switching transistor T10 is connected to an input terminal of the eleventh switching transistor T11 and a control terminal of the twelfth switching transistor T12. A control terminal of the eleventh switching transistor T11 is connected to the point Q1, and an output terminal of the eleventh switching transistor T11 is connected to the first low level voltage VSS2. An input terminal of the twelfth switching transistor T12 is configured to receive the pull-down control signal VDD_0, and an output terminal of the twelfth switching transistor T12 is connected to a pull-down point QB, and configured to output the pull-down signal. The control terminal of the thirteenth switching transistor T13 is connected to the point Q1, an input terminal of the thirteenth switching transistor T13 is connected to the pull-down point QB, and an output terminal of the thirteenth switching transistor T13 is connected to the first low level voltage VSS2. The control terminal of the fourteenth switching transistor T14 is configured to receive the trigger signal, an input terminal of the fourteenth switching transistor T14 is connected to the pull-down point QB, and an output terminal of the fourteenth switching transistor T14 is connected to the first low level voltage VSS2.

When the pull-down control signal VDD_0 is at the high level, the tenth switching transistor T10 is turned on. The twelfth switching transistor T12 is turned on, the pull-down point QB is at the high level, and the pull-down signal is at the high level. When the point Q1 is at the high level, the eleventh switching transistor T11 is turned on, the control terminal of the twelfth switching transistor T12 is at the low level, and the twelfth switching transistor T12 is turned off. The control terminal of the thirteenth switching transistor T13 is at the high level, the thirteenth switching transistor T13 is turned on, and the pull-down point QB is at the low level. Thus, the situation that the control signal is at the high level and the pull-down signal is at the low level is realized, and the pulling down of the voltages of the first output signal Gout(n), the second output signal Gout(n+1) and the point Q1 is stopped.

When the trigger signal received by the control terminal of the fourteenth switching transistor T14 is at the high level, the fourteenth switching transistor T14 is turned on, and the pull-down point QB is at the low level, which further ensures that the point Q1 is at the high level and the pull-down point QB is at the low level.

Further, the pull-down sub-circuit 22 includes a first switching transistor T1, a second switching transistor T2, and a third switching transistor T3.

A control terminal of the first switching transistor T1 is configured to receive the pull-down signal, an input terminal of the first switching transistor T1 is connected to the point Q1, and an output terminal of the first switching transistor T1 is connected to the first low level voltage VSS2.

A control terminal of the second switching transistor T2 is configured to receive the pull-down signal, an input terminal of the second switching transistor T2 is connected to the output terminal of the first sub-output circuit 310, and an output terminal of the second switching transistor T2 is connected to the second low level voltage VSS1.

A control terminal of the third switching transistor T3 is configured to receive the pull-down signal, an input terminal of the third switching transistor T3 is connected to the output terminal of the second sub-output circuit 330, and an output terminal of the third switching transistor T3 is connected to the second low level voltage VSS1.

It should be noted that the pull-down sub-circuit 22 may further include a fifteenth switching transistor T15, a control terminal of the fifteenth switching transistor T15 is configured to receive a first pull-down trigger signal, an input terminal of the fifteenth switching transistor T15 is connected to the point Q1, and an output terminal of the fifteenth switching transistor T15 is connected to the first low level voltage VSS2.

When the first pull-down trigger signal is at the high level, the fifteenth switching transistor T15 is turned on, and the voltage at the point Q1 is pulled down to the low level. When the pull-down point QB is at the high level, that is, the pull-down signal is at the high level, the first switching transistor T1 is turned on to pull down the point Q1. The second switching transistor T2 is turned on, and pulls down the voltage at the output terminal of the first sub-output circuit 310 to the low level. The third switching transistor T3 is turned on, and pulls down the voltage at the output terminal of the second sub-output circuit 330 to the low level.

Based on the foregoing hardware structure, the working process of the driving circuit can be as follows.

When the trigger signal is at the high level, the seventh switching transistor T7 is turned on, and the point Q1 is at the high level. The fourteenth switching transistor T14 is turned on, and the pull-down point QB is at the low level. The eighth switching transistor T8 is turned on to receive the first clock signal CLK1 and output the driving signal Gout (n). The isolation switching transistor S_TFT is turned on, and the ninth switching transistor T9 is turned on to receive the second clock signal CLK2 and output the driving signal Gout(n+1). The fifth switching transistor T5 is turned on to receive the first clock signal CLK1 and output the cascading down signal Carry(n). When the trigger signal is at the low level, the seventh switching transistor T7 is turned off, and the fourteenth switching transistor T14 is turned off. The first capacitor C1 and the second capacitor C2 are discharged, and the eighth switching transistor T8 is turned on to receive the first clock signal CLK1 and output the driving signal Gout(n). The ninth switching transistor T9 is turned on to receive the second clock signal CLK2 and output the driving signal Gout(n+1). When the pull-down control signal VDD_0 is at the high level, the tenth switching transistor T10 and the twelfth switching transistor T12 are turned on, and the pull-down point QB is at the high level. The second switching transistor T2 and the third switching transistor T3 are turned on, and the voltage of the driving signal Gout(n) and the Gout(n+1) are pulled down to the low level.

Based on the foregoing hardware structure, in this embodiment, the first isolation switch 320 is arranged between the first sub-output circuit 310 and the second sub-output circuit 330, the mutual influence between the first sub-output circuit 310 and the second sub-output circuit 330 is reduced, and the problem of abnormal output signals is solved, and the output signal is stabilized on the basis of narrowing the frame of the display product.

Figure 5:
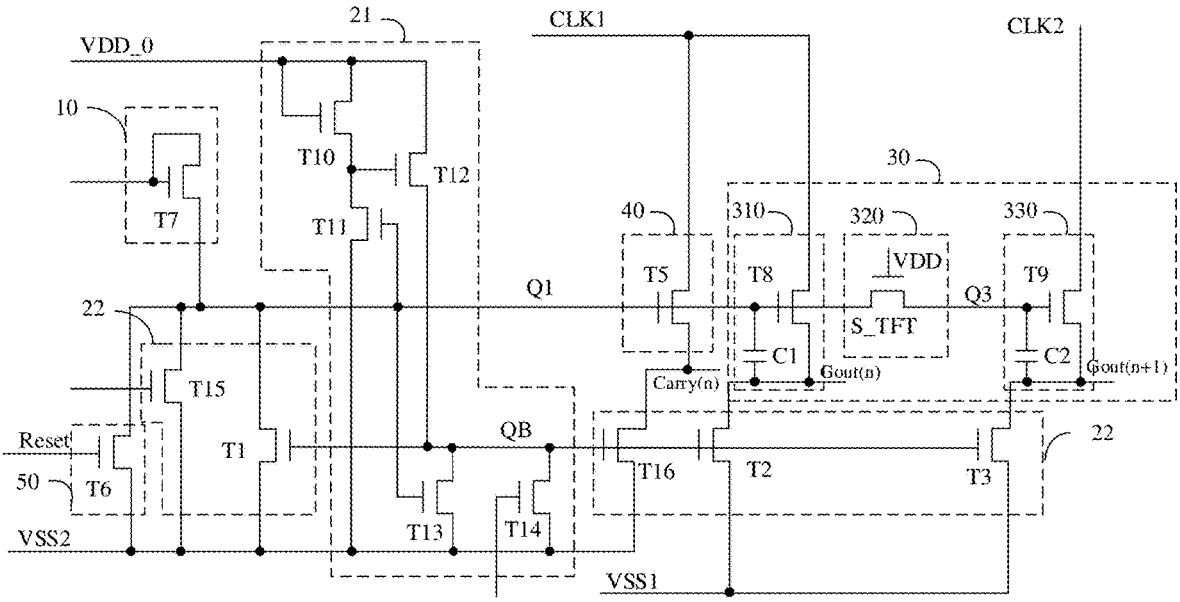
FIG. 5 is a schematic circuit diagram of the driving circuit according to another embodiment of the present disclosure.

Referring to FIG. 5, in another embodiment of the driving circuit of the present disclosure, the pull-down sub-circuit 22 further includes a sixteenth switching transistor T16. A control terminal of the sixteenth switching transistor T16 is connected to the pull-down point QB and configured to receive the pull-down signal, an input terminal of the sixteenth switching transistor T16 is connected to an output terminal of the cascading down circuit 40, and an output terminal of the sixteenth switching transistor T16 is connected to the first low level voltage VSS2.

When the pull-down point QB is at the high level, the sixteenth switching transistor T16 is turned on to pull down the voltage at the output terminal of the cascading down circuit 50.

Figure 6:
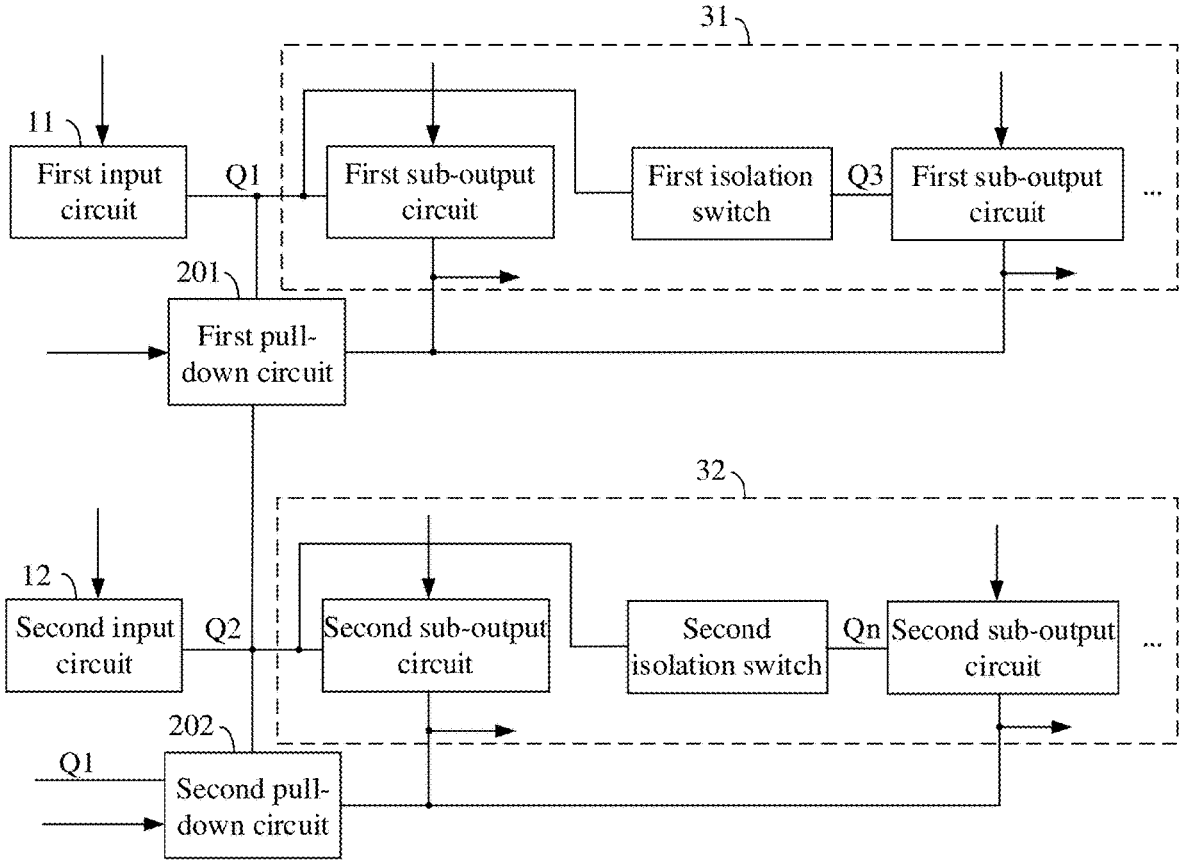
FIG. 6 is a schematic block diagram of a multi-stage driving circuit according to an embodiment of the present application.

The present disclosure further provides a multi-stage driving circuit. Referring to FIG. 6, in an embodiment, the multi-stage driving circuit includes a first driving circuit and a second driving circuit.

The first driving circuit includes a first input circuit 11, a first pull-down circuit 201 and a first output circuit 31.

The first output circuit 31 includes at least two first sub-output circuits, a control terminal of a first one of the first sub-output circuits of the first output circuit 31 is connected to an output terminal of the first input circuit 11, and control terminals of two adjacent first sub-output circuits are connected by at least one first isolation switch.

The first input circuit 11 is configured to output a first control signal upon receiving a first trigger signal.

The first isolation switch is configured to establish connection between the control terminals of the adjacent first sub-output circuits upon receiving a first turn-on signal, and disconnect the connection between the control terminals of the adjacent first sub-output circuits upon receiving a first turn-off signal is received.

Each first sub-output circuit is configured for receiving a corresponding input signal, and outputting a corresponding output signal according to the first control signal and the corresponding input signal.

A first terminal of the first pull-down circuit 201 is connected to the output terminal of the first input circuit 11 and an output terminal of each first sub-output circuit, and a second terminal of the first pull-down circuit 201 is connected to a low level voltage. The first pull-down circuit 201 is configured to pull down the first control signal and the output signal of each first sub-output circuit to a low level when a first pull-down control signal is at a high level, and stop to pull down the control signal and the output signal of each first sub-output circuit when a second control signal, the first trigger signal or the first control signal is at the high level.

The second driving circuit includes a second input circuit 12, a second pull-down circuit 202 and a second output circuit 32.

The second output circuit 32 includes at least two second sub-output circuits. A control terminal of a first one of the second sub-output circuits of the second output circuit 32 is connected to an output terminal of the second input circuit 12, and control terminals of the two adjacent second sub-output circuits are connected by at least one second isolation switch.

The second input circuit 12 is configured to output a second control signal upon receiving a second trigger signal.

The second isolation switch is configured to establish connection between the control terminals of the adjacent second sub-output circuits upon receiving a second turn-on signal, and disconnect the connection between the control terminals of the adjacent second sub-output circuits upon receiving a second turn-off signal.

Each second sub-output circuit is configured to receive a corresponding input signal and output a corresponding output signal according to the second control signal and the corresponding input signal.

A first terminal of the second pull-down circuit 202 is connected to the output terminal of the second input circuit 12 and an output terminal of each second sub-output circuit, and a second terminal of the second pull-down circuit 202 is connected to the low level voltage. The second pull-down circuit 202 is configured to pull down the second control signal and the output signal of each second sub-output circuit to a low level when a second pull-down control signal is at a high level, and stop to pull down the second control signal and the output signal of each first sub-output circuit when the second trigger signal, the first control signal or the second control signal is at the high level. The first pull-down control signal and the second pull-down control signal are opposite.

In this embodiment, multi-stage output can be achieved through two-stage inputs, so that the number of components is greatly reduced, and the frame of the display product is further narrowed. The output circuits does not affect each other, and the signal is more stable.

Figure 7:
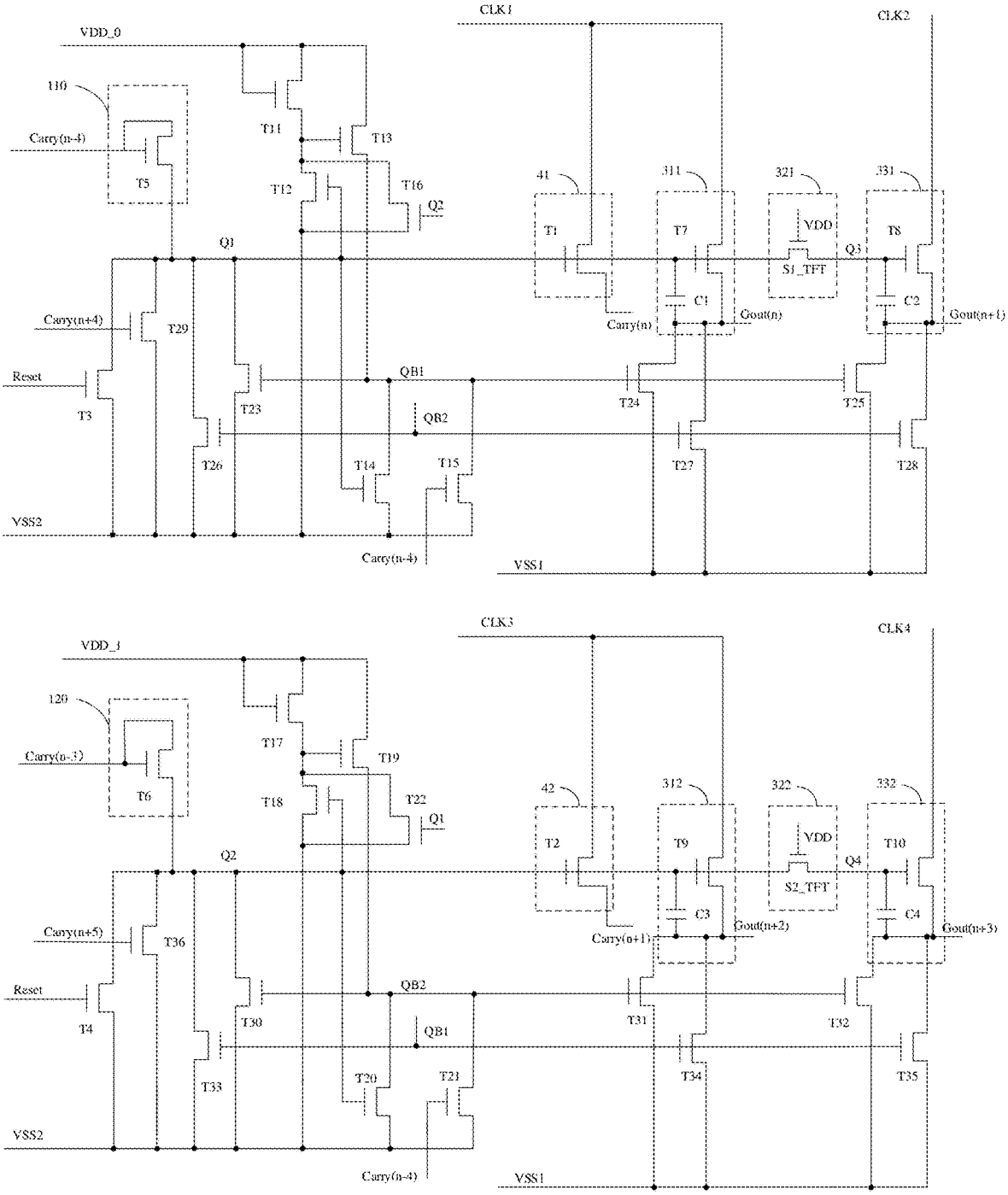
FIG. 7 is a schematic circuit diagram of the multi-stage driving circuit according to an embodiment of the present application.

Referring to FIG. 7, a four-stage driving circuit is taken as an example of the multi-stage circuit. The first driving circuit includes a first input circuit 110, a first sub-output circuit 311, a first isolation switch 321, a second sub-output circuit 331 and a first pull-down circuit. The second drive circuit includes a second input circuit 120, a third sub-output circuit 312, a second isolation switch 322, a fourth sub-output circuit 332 and a second pull-down circuit.

In an embodiment, the first driving circuit further includes a first cascading down circuit 41. A control terminal of the cascading down circuit 41 is connected to an output terminal of the first input circuit 110, and configured to output a first cascading down signal Carry(n) upon receiving the first control signal and the first input signal CLK1.

The second driving circuit further includes a second cascading down circuit 42. A control terminal of the second cascading down circuit 42 is connected to an output terminal of the second input circuit 120, and the second cascading down circuit 42 is configured to output a second cascading down signal Carry(n+1) upon receiving the second control signal and the second input signal CLK2.

The structures of the first-cascading down circuit 41 and the second-cascading down circuit 42 may be set according to actual needs. For example, the first-cascading down circuit 41 may include a first switching transistor T1. A control terminal of the first switching transistor T1 is connected to the first point Q1, an input terminal of the first switching transistor T1 is configured to receive the first input signal CLK1, and an output terminal of the first switching transistor T1 is configured to output the first-cascading down signal Cary(n).

The second cascading down circuit 42 may include a second switching transistor T2. A control terminal of the second switching transistor T2 is connected to the second point Q2, an input terminal of the second switching transistor T2 is configured to receive the third input signal CLK3, and an output terminal of the second switching transistor T2 is configured to output the second cascading down signal Carry(n+1).

Further, the first driving circuit further includes a first reset circuit. A control terminal of the first reset circuit is configured to receive a reset signal Reset, an input terminal of the first reset circuit is connected to the output terminal of the first input circuit 110, and an output terminal of the first reset circuit is connected to a first low level voltage VSS2.

The second driving circuit further includes a second reset circuit, a control terminal of the second reset circuit is configured to receive the reset signal Reset, an input terminal of the second reset circuit is connected to the output terminal of the second input circuit 120, and an output terminal of the second reset circuit is connected to the first low level voltage VSS2.

In an embodiment, the first reset circuit may include a third switching transistor T3, and the second reset circuit may include a fourth switching transistor T4, a control terminal of the third switching transistor T3 and a control terminal of the fourth switching transistor T4 are configured to receive the reset signal Reset, an input terminal of the third switching transistor T3 is connected to the first point Q1, an input terminal of the fourth switching transistor T4 is connected to the second point Q2, and an output terminal of the third switching transistor T3 and an output terminal of the fourth switching transistor T4 are connected to the first low level voltage VSS2.

When the reset signal Reset is at the high level, the third switching transistor T3 and the fourth switching transistor T4 are turned on, and voltages at the first point Q1 and the second point Q2 are pulled down to the low level.

Further, the first input circuit 110 may include a fifth switching transistor T5. A control terminal of the fifth switching transistor T5 is connected to the input terminal of the fifth switching transistor T5 and configured to receive the first trigger signal Carry(n−4), and an output terminal of the fifth switching transistor T5 is the output terminal of the first input circuit 110 and connected to the first point Q1.

When the first trigger signal Carry(n−4) is at the high level, the fifth switching transistor T5 is turned on, the first control signal is at the high level, and the first point Q1 is at the high level.

The second input circuit 120 may include a sixth switching transistor T6. A control terminal of the sixth switching transistor T6 is connected to the input terminal of the sixth switching transistor T6 and configured to receive the second trigger signal Carry(n−3), and an output terminal of the sixth switching transistor T6 is the output terminal of the second input circuit 120 and connected to the second point Q2.

When the second trigger signal Carry(n−3) is at the high level, the sixth switching transistor T6 is turned on, the second control signal is at the high level, and the second point Q2 is at the high level.

Further, the first sub-output circuit 311 may include a seventh switching transistor T7 and a first capacitor C1. A control terminal of the seventh switching transistor T7 is connected to the first point Q1, an input terminal of the seventh switching transistor T7 is configured to receive the first input signal CLK1, and an output terminal of the seventh switching transistor T7 is configured to output the first output signal Gout(n). One terminal of the first capacitor C1 is connected to the control terminal of the seventh switching transistor T7, and the other terminal of the first capacitor C1 is connected to the output terminal of the seventh switching transistor T7.

The first isolation switch 321 includes a first isolation switching transistor S1_TFT. A control terminal of the first isolation switching transistor S1_TFT is connected to the high level voltage VDD, a first terminal of the first isolation switching transistor S1_TFT is connected to the first point Q1, and a second terminal of the first isolation switching transistor S1_TFT is connected to the control terminal of the second sub-output circuit 331.

The second sub-output circuit 331 may include an eighth switching transistor T8 and a second capacitor C2. A control terminal of the eighth switching transistor T8 is connected to the second terminal of the first isolation switching transistor S1_TFT, an input terminal of the eighth switching transistor T8 is configured to receive the second input signal CLK2, an output terminal of the eighth switching transistor T8 is configured to output the second output signal Gout(n+1). One terminal of the second capacitor C2 is connected to the control terminal of the eighth switching transistor T8, and the other terminal of the second capacitor C2 is connected to the output terminal of the eighth switching transistor T8.

The control terminal of the seventh switching transistor T7 is connected to the first point Q1. The first point Q1 is at the high level. The control terminal of the first isolation switching transistor S1_TFT is connected to the high level voltage VDD. A voltage difference between the gate and the source of the first isolation switching transistor S1_TFT is greater than the conduction threshold, and the first isolation switching transistor S1_TFT is turned on. The point Q3 is at the high level, and the source of the first isolation switching transistor S1_TFT is at the high level. The voltage between the gate and the source is less than the conduction threshold, the first isolation switching transistor S1_TFT is turned off, and the control terminal of the seventh switching transistor T7 is isolated from the eighth switching transistor T8 through the first switching transistor S1_TFT. The seventh switching transistor T7 outputs Gout(n) according to the first clock signal CLK1, and the eighth switching transistor T8 outputs Gout(n+1) according to the second clock signal CLK2. The first input signal is the first clock signal CLK1, and the second input signal is the second clock signal CLK2. The first output signal is the driving signal Gout(n), and the second output signal is the driving signal Gout(n+1). The control terminal of the seventh switching transistor T7 is isolated from the control terminal of the eighth switching transistor T8 through the first isolation switching transistor S1_TFT. The deterioration of the TFT due to the high voltage is alleviated, and thus the corresponding output signal is more stable.

The third sub-output circuit 312 may include a ninth switching transistor T9 and a third capacitor C3. A control terminal of the ninth switching transistor T9 is connected to the second point Q2, an input terminal of the ninth switching transistor T9 is configured to receive the third input signal CLK3, and an output terminal of the ninth switching transistor T9 is configured to output the third output signal Gout (n+2). One terminal of the third capacitor C3 is connected to the control terminal of the ninth switching transistor T9, and the other terminal of the third capacitor C3 is connected to the output terminal of the ninth switching transistor T9.

The second isolation switch 322 includes a second isolation switching transistor S2_TFT. A control terminal of the second isolation switching transistor S2_TFT is connected to the high level voltage VDD, a first terminal of the second isolation switching transistor S2_TFT is connected to the second point Q2, and a second terminal of the second isolation switching transistor S2_TFT is connected to a control terminal of the fourth sub-output circuit 332;

The fourth sub-output circuit 332 may include a tenth switching transistor T10 and a fourth capacitor C4. A control terminal of the tenth switching transistor T10 is connected to the second terminal of the second isolation switching transistor S2_TFT, an input terminal of the tenth switching transistor T10 is configured to receive the fourth input signal CLK4, an output terminal of the tenth switching transistor T10 is configured to output the fourth output signal Gout (n+3). One terminal of the fourth capacitor C4 is connected to the control terminal of the tenth switching transistor T10, and the other terminal of the fourth capacitor C4 is connected to the output terminal of the tenth switching transistor T10.

The control terminal of the ninth switching transistor T9 is connected to the second point Q2. When the second control signal is at the high level, the second point Q2 is at the high level. The control terminal of the second isolation switching transistor S2_TFT is connected to the high level voltage VDD. A voltage difference between the gate and the source of the second isolation switching transistor S2_TFT is greater than the conduction threshold, and the second isolation switching transistor S2_TFT is turned on. The fourth point Q4 is at the high level. The voltage difference between the gate and the source is less than the conduction threshold, the second isolation switching transistor S2_TFT is turned off, and the control terminal of the ninth switching transistor T9 is isolated from the tenth switching transistor T10 through the second isolation switching transistor S2_TFT. The ninth switching transistor T9 outputs Gout(n+2) according to the third clock signal CLK3, and the tenth switching transistor T10 outputs Gout(n+3) according to the fourth clock signal CLK4. The third input signal is the third clock signal CLK3, and the fourth input signal is the fourth clock signal CLK4. The third output signal is the driving signal Gout(n+2), and the fourth output signal is the driving signal Gout(n+3). The control terminal of the ninth switching transistor T9 is isolated from the control terminal of the tenth switching transistor T10 by the second isolation switching transistor S2_TFT. The deterioration of the TFT due to the high voltage is alleviated, and thus the corresponding output signal is more stable.

The third capacitor C3 and the fourth capacitor C4 are mainly configured to maintain the voltage difference between the control terminal and the output terminal of the ninth switching transistor T9 and the voltage difference between the control terminal and the output terminal of the tenth switching transistor T10 to stabilize the output of the ninth switching transistor T9 and the output of the tenth switching transistor T10.

Further, the first pull-down circuit includes a first pull-down holding circuit and a first pull-down sub-circuit.

The first pull-down holding circuit may include an eleventh switching transistor T11, a twelfth switching transistor T12, a thirteenth switching transistor T13, a fourteenth switching transistor T14, a fifteenth switching transistor T15, and a sixteenth switching transistor T16.

A control terminal of the eleventh switching transistor T11 is connected to an input terminal of the eleventh switching transistor T11 and configured to receive the first pull-down control signal VDD_0, an output terminal of the eleventh switching transistor T11 is connected to the input terminal of the twelfth switching transistor T12 and a control terminal of the thirteenth switching transistor T13, and an output terminal of the twelfth switching transistor T12 is connected to the first low level voltage VSS2. An input terminal of the thirteenth switching transistor T13 is configured to receive the first pull-down control signal VDD_0, and an output terminal of the thirteenth switching transistor T13 is connected to a first pull-down point QB1 to output the first pull-down signal. A control terminal of the fourteenth switching transistor T14 is connected to the first point Q1, an input terminal of the fourteenth switching transistor T14 is connected to the first pull-down point QB1, and an output terminal of the fourteenth switching transistor T14 is connected to the first low level voltage VSS2. The control terminal of the fifteenth switching transistor T15 is configured to receive the trigger signal Carry(n−4), an input terminal of the fifteenth switching transistor T15 is connected to the first pull-down point QB1, and an output terminal of the fifteenth switching transistor T15 is connected to the first low level voltage VSS2. A control terminal of the sixteenth switching transistor T16 is connected to the second point Q2 and configured to receive the second control signal, an input terminal of the sixteenth switching transistor T16 is connected to the control terminal of the thirteenth switching transistor T13, and an output terminal of the sixteenth switching transistor T16 is connected to the first low level voltage VSS2.

When the first pull-down control signal VDD_0 is at the high level, the eleventh switching transistor T11 and the thirteenth switching transistor T13 are turned on, the first pull-down point QB1 is at the high level, and the first pull-down signal is at the high level. When the first point Q1 is at the high level, the twelfth switching transistor T12 is turned on, the control terminal of the thirteenth switching transistor T13 is at the low level and the thirteenth switching transistor T13 is turned off, the control terminal of the fourteenth switching transistor T14 is at the high level and the fourteenth switching transistor T14 is turned on, and the first pull-down point QB1 is at the low level. When the second point Q2 is at the high level, the sixteenth switching transistor T16 is turned on, the control terminal of the thirteenth switching transistor T13 is at the low level and the thirteenth switching transistor T13 is turned off. Thus, the situation that the first control signal or the second control signal is at the high level and the first pull-down signal is at the low level is realized, and the pulling down of the voltages of the first output signal Gout(n), the second output signal Gout(n+1) and the point Q1 is stopped.

When the first trigger signal Carry(n−4) received by the control terminal of the fifteenth switching transistor T15 is at the high level, the fifteenth switching transistor T15 is turned on, the first pull-down point QB1 is at the low level, which further ensures that the first point Q1 is at the high level and the first pull-down point QB1 is at the low level.

Further, the second pull-down circuit includes a second pull-down holding circuit and a second pull-down sub-circuit.

The second pull-down holding circuit may include a seventeenth switching transistor T17, an eighteenth switching transistor T18, a nineteenth switching transistor T19, a twentieth switching transistor T20, a twenty-first switching transistor T21, and a twenty-second switching transistor T22.

A control terminal of the seventeenth switching transistor T17 is connected to an input terminal of the seventeenth switching transistor T17 and configured to receive the second pull-down control signal VDD_1, and an output terminal of the seventeenth switching transistor T17 is connected to an input terminal of the eighteenth switching transistor T18 and a control terminal of the nineteenth switching transistor T19. A control terminal of the eighteenth switching transistor T18 is connected to the second point Q2, and an output terminal of the eighteenth switching transistor T18 is connected to the first low level voltage VSS2. An input terminal of the nineteenth switching transistor T19 is configured to receive the second pull-down control signal VDD_1, and an output terminal of the nineteenth switching transistor T19 is connected to the second pull-down point QB2 and configured to output the second pull-down signal. A control terminal of the twentieth switching transistor T20 is connected to the second point Q2, an input terminal of the twentieth switching transistor T20 is connected to the second pull-down point QB2, and an output terminal of the twentieth switching transistor T20 is connected to the first low level voltage VSS2. A control terminal of the twenty-first switching transistor T21 is configured to receive the first trigger signal Carry(n−4), an input terminal of the twenty-first switching transistor T21 is connected to the second pull-down point QB2, and an output terminal of the twenty-first switching transistor T21 is connected to the first low level voltage VSS2. A control terminal of the twenty-second switching transistor T22 is connected to the first point Q1 and configured to receive a first control signal, an input terminal of the twenty-second switching transistor T22 is connected to the control terminal of the nineteenth switching transistor T19, and the output terminal of the twenty-second switching transistor T22 is connected to the first low level voltage VSS2.

When the second pull-down control signal VDD_1 is at the high level, the second pull-down signal is at the high level. The second point Q2 is at the high level, and the second pull-down point QB2 is at the low level. When the first point Q1 is at the high level, the twenty-second switching transistor T22 is turned on, the control terminal of the nineteenth switching transistor T19 is at the low level and the nineteenth switching transistor T19 is turned off. Thus, the situation that the first control signal or the second control signal is at the high level and the second pull-down signal is at the low level and the second pull-down point QB2 is at the low level, and the pulling down of the voltages of the third output signal Gout(n+2), the fourth output signal Gout(n+3) and the second point Q2 is stopped.

When the first trigger signal Carry(n−4) received by the control terminal of the twenty-first switching transistor T21 is at the high level, the twenty-first switching transistor T21 is turned on. The second pull-down point QB1 is at the low level, which further ensures that the first point Q1 is at the high level and the second pull-down point QB2 is at the low level, and the pulling down is stopped.

It should be noted that the voltage level of the first pull-down control signal VDD_0 is opposite to the voltage level of the second pull-down control signal VDD_1, that is, when the first pull-down control signal VDD_0 is at the high level, the second pull-down control signal VDD_1 is at the low level.

Further, the first pull-down sub-circuit includes a twenty-third switching transistor T23, a twenty-fourth switching transistor T24, and a twenty-fifth switching transistor T25.

A control terminal of the twenty-third switching transistor T23 is connected to the first pull-down point QB1 and configured to receive the first pull-down signal, an input terminal of the twenty-third switching transistor T23 is connected to the first point Q1, and an output terminal of the twenty-third switching transistor T23 is connected to the first low level voltage VSS2.

A control terminal of the twenty-fourth switching transistor T24 is connected to the first pull-down point QB1 and configured to receive the first pull-down signal, an input terminal of the twenty-fourth switching transistor T24 is connected to the output terminal of the first sub-output circuit 311, and an output terminal of the twenty-fourth switching transistor T24 is connected to the second low level voltage VSS1.

A control terminal of the twenty-fifth switching transistor T25 is connected to the first pull-down point QB1 and configured to receive the first pull-down signal, an input terminal of the twenty-fifth switching transistor T25 is connected to the output terminal of the second sub-output circuit 331, and an output terminal of the twenty-fifth switching transistor T25 is connected to the second low level voltage VSS1.

The first pull-down sub-circuit may further include a twenty-sixth switching transistor T26, a twenty-seventh switching transistor T27, and a twenty-eighth switching transistor T28.

A control terminal of the twenty-sixth switching transistor T26 is connected to the second pull-down point QB2 and configured to receive the second pull-down signal, an input terminal of the twenty-sixth switching transistor T26 is connected to the first point Q1, and an output terminal of the twenty-sixth switching transistor T26 is connected to the first low level voltage VSS2.

A control terminal of the twenty-seventh switching transistor T27 is connected to the second pull-down point QB2 and configured to receive the second pull-down signal, an input terminal of the twenty-seventh switching transistor T27 is connected to the output terminal of the first sub-output circuit 311, and an output terminal of the twenty-seventh switching transistor T27 is connected to the second low level voltage VSS1.

A control terminal of the twenty-eighth switching transistor T28 is connected to the second pull-down point QB2 and configured to receive the second pull-down signal, an input terminal of the twenty-eighth switching transistor T28 is connected to the output terminal of the second sub-output circuit 331, and an output terminal of the twenty-eighth switching transistor T28 is connected to the second low level voltage VSS1.

Therefore, when the first pull-down signal or the second pull-down signal is at the high level, the voltages at the output terminal of the first sub-output circuit 311 and the output terminal of the second sub-output circuit 331 are pulled down.

The first pull-down sub-circuit may further include a twenty-ninth switching transistor T29. A control terminal of the twenty-ninth switching transistor T29 is configured to receive the first pull-down trigger signal Carry(n+4), an input terminal of the twenty-ninth switching transistor T29 is connected to the first point Q1, and an output terminal of the twenty-ninth switching transistor T29 is connected to the first low level voltage VSS2. When the first pull-down trigger signal Carry(n+4) is at the high level, the voltage at the first point Q1 is pulled down.

Further, the second pull-down sub-circuit includes a thirty switching transistor T30, a thirty-first switching transistor T31, and a thirty-second switching transistor T32.

A control terminal of the thirteenth switching transistor T30 is connected to the second pull-down point QB2 and configured to receive the second pull-down signal, an input terminal of the thirty-first switching transistor T30 is connected to the second point Q2, and the output terminal of the thirty-second switching transistor T30 is connected to the first low level voltage VSS2.

A control terminal of the thirty-first switching transistor T31 is connected to the second pull-down point QB2 and configured to receive the second pull-down signal, an input terminal of the thirty-first switching transistor T31 is connected to the output terminal of the third sub-output circuit 312, and an output terminal of the thirty-first switching transistor T31 is connected to the second low level voltage VSS1.

A control terminal of the thirty-second switching transistor T32 is connected to the second pull-down point QB2 and configured to receive the second pull-down signal, an input terminal of the thirty-second switching transistor T32 is connected to the output terminal of the fourth sub-output circuit 332, and an output terminal of the thirty-second switching transistor T32 is connected to the second low level voltage VSS1.

The second pull-down sub-circuit may further include a thirty-third switching transistor T33, a thirty-fourth switching transistor T34, and a thirty-fifth switching transistor T35.

A control terminal of the thirteenth switching transistor T33 is connected to the first pull-down point QB1 and configured to receive the first pull-down signal, an input terminal of the thirty-third switching transistor T33 is connected to the second point Q2, and an output terminal of the thirty-third switching transistor T33 is connected to the first low level voltage VSS2.

A control terminal of the thirty-fourth switching transistor T34 is connected to the first pull-down point QB1 and configured to receive the first pull-down signal, an input terminal of the thirty-fourth switching transistor T34 is connected to the output terminal of the third sub-output circuit 312, and an output terminal of the thirty-fourth switching transistor T34 is connected to the second low level voltage VSS1.

A control terminal of the thirty-fifth switching transistor T35 is connected to the first pull-down point QB1 and configured to receive the first pull-down signal, an input terminal of the thirty-fifth switching transistor T35 is connected to the output terminal of the fourth sub-output circuit 332, and an output terminal of the thirty-fifth switching transistor T35 is connected to the second low level voltage VSS1.

Therefore, when the first pull-down signal or the second pull-down signal is at the low level, the voltage at the second point Q2, the voltage at the output terminal of the third sub-output circuit 312 and the voltage at the output terminal of the fourth sub-output circuit 332 are pulled down.

The second pull-down sub-circuit may further include a thirty-sixth switching transistor T36. A control terminal of the thirty-sixth switching transistor T36 is configured to receive the second pull-down trigger signal Carry(n+5), an input terminal of the thirty-sixth switching transistor T36 is connected to the second point Q2, and an output terminal of the thirty-sixth switching transistor T36 is connected to the first low level voltage VSS2. When the second pull-down trigger signal Carry(n+5) is at a high level, the voltage at the second point Q2 is pulled down.

Referring to FIG. 8 to FIG. 12, based on the foregoing hardware structure, the process of implementing the output of the gate driving signal in this embodiment may be divided into five stages.

Figure 8:
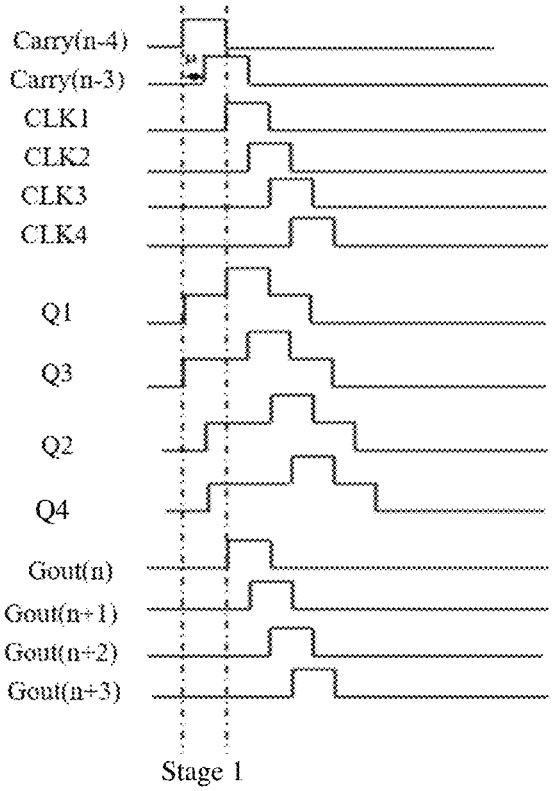
FIG. 8 is a control timing diagram of a first stage in the embodiment of FIG. 7.

Stage 1. As shown in FIG. 8, VGH is set to be 30 V, and VGL is set to be −15 V. When Carry(n−4) is at the high level VGH, the fifth switching transistor T5 is turned on. The point Q1 is at the high level VGH. VDD is a DC high voltage VGH, the first isolation switching transistor S1_TFT is turned on, and the voltage at Q3 is equal to the Q1 voltage (that is, VQ3=VQ1=VGH). The seventh switching transistor T7 and the eighth switching transistor T8 are turned on, the seventh switching transistor T7 receives the voltage of CLK1, and the eighth switching transistor T8 receives the voltage of CLK2. At this time, the voltages of CLK1 and CLK2 are VGL, that is, the voltage of the first output signal Gout(n) and the voltage of the second output signal Gout (n+1) are −15 V. At this time, the voltage difference between the two terminals of each of the capacitors C1 and C2 is 45 V. Carry(n−3) is at the low level during the μ time, since the sixth switching transistor T6 is turned on, the voltage at Q2 is VGL. After a period of time, Carry (n−3) is at the high level, and the sixth switching transistor T6 is turned on. The voltage at the second point Q2 is VGH, and the second isolation switching transistor S2_TFT is turned on. The voltage at the fourth point Q4 is equal to that at the second point Q2, and the voltages of the third output signal Gout (n+2) and the fourth output signal Gout (n+3) are both VGL.

Figure 9:
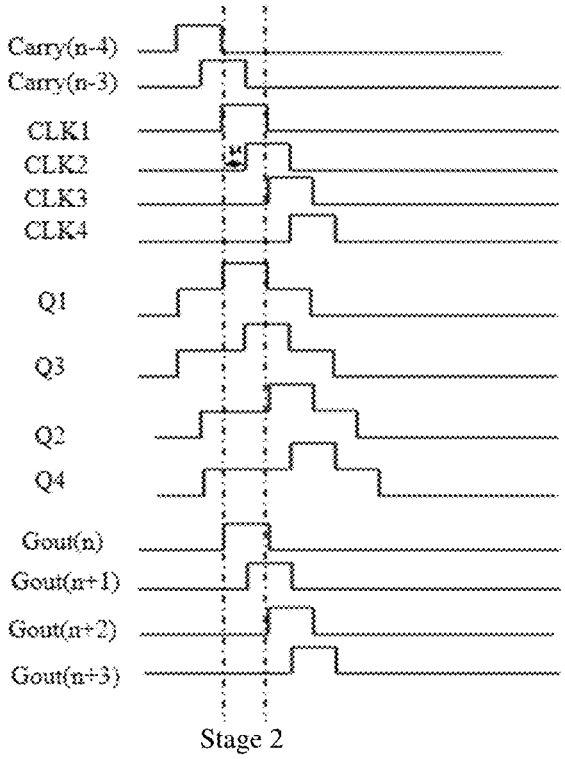
FIG. 9 is a control timing diagram of a second stage in the embodiment of FIG. 7.

Stage 2. As shown in FIG. 9, the fifth switching transistor T5 is turned off, a time interval between the CLK1 switching to the high level and the CLK2 switching to the high level is μ, the seventh switching transistor T7 is maintained to be turned on due to a holding effect of the first capacitor C1, and the voltage at the first point Q1 rises to VGH+ΔV (ΔV is VGH-VGL in theory). Since the voltage difference VGS between the gate and the source of the first isolation switching transistor S1_TFT is VDD−VQ3=0, and less than the threshold voltage Vth, the first isolation switching transistor S1_TFT is turned off, and the voltage at the third point Q3 is maintained due to a holding effect of the second capacitor C2. The eighth switching transistor T8 is turned on, the seventh switching transistor T7 receives the high voltage of CLK1, and the eighth switching transistor T8 receives the low voltage of CLK2, that is, the voltage of the second output signal Gout(n+1) is VGL. After μ time, CLK2 is switched to VGH, that is, the voltage of the second output signal Gout(n+1) is VGH, and a voltage variation at the third point Q3 is also ΔV, that is, VQ3=VGH+ΔV, the voltage of the second driving signal Gout(n+1) is VGH. At this stage the voltages of CLK3 and CLK4 are both VGL, that is, the voltage of the third output signal Gout(n+2) and the voltage of the fourth output signal Gout(n+3) are VGL.

Figure 10:
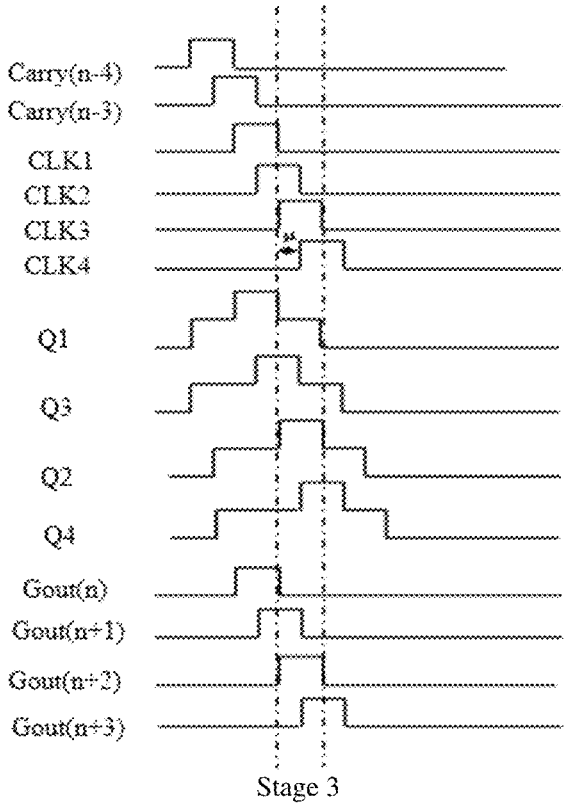
FIG. 10 is a control timing diagram of a third stage in the embodiment of FIG. 7.

Stage 3. As shown in FIG. 10, Carry(n−4) is switched to the low voltage VGL, the fifth switching transistor T5 is turned off, and due to the holding effect of the capacitor C1, the seventh switching transistor T7 is continuously turned on. At this time, CLK1 is switched to the low voltage VGL. Because of the coupling of the capacitor C1, the voltage variation at the first point Q1 is −ΔV. That is, the voltage at the first point Q1 is VGH. During the μ time, because the voltage difference VGS between the gate and the source of the first isolation switching transistor S1_TFT is equal to VDD−VQ3 and less than 0, that is, less than the threshold voltage Vth, the first isolation switching transistor S1_TFT is turned off, and the voltage at the third point Q3 is unchanged due to the holding effect of the second capacitor C2. The seventh switching transistor T7 and the eighth switching transistor T8 are turned on. The seventh switching transistor T7 receives the high voltage of CLK1, and the eighth switching transistor T8 receives the high voltage of CLK2, that is, VGout(n+1) is VGH. After the μ time, CLK2 is switched to the low voltage, that is, the second output signal Gout(n+1) is switched to the low voltage VGL. CLK3 is switched to the low voltage, that is, the third output signal VGout (n+2) is switched to the low voltage VGL, and the fourth output signal Gout(n+3) is also switched to the low voltage VGL.

Figure 11:
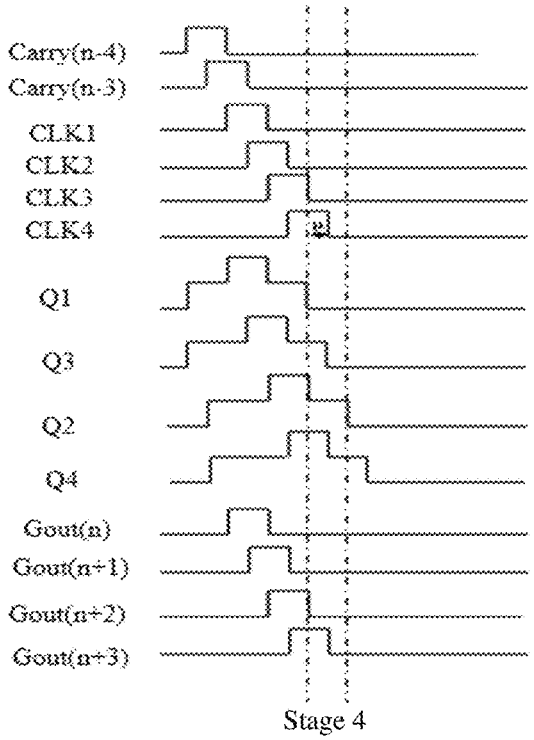
FIG. 11 is a control timing diagram of a fourth stage in the embodiment of FIG. 7.

Stage 4. As shown in FIG. 11, Carry(n−4) is switched to the low voltage VGL, and at this time, the fifth switching transistor T5 is turned off, the voltage at the first point Q1 at the previous stage is the high voltage and the fourteenth switching transistor is turned on. At stage 5, the sixteen switching transistor is turned on because that the second point Q2 is at the high voltage, the first point Q1 receives VSS1, that is, receives VGL. The voltage at the second point Q2 remains unchanged due to the holding effect of the third capacitor C3. During the μ time, for CLK4 is switched to the high voltage, the voltage at the fourth point Q4 is unchanged as compared to the voltage in the previous stage, and the voltage of the fourth output signal Gout(n+3) is the high voltage VGH. After the μ time, for CLK4 is switched to the low voltage, the voltage variation at the fourth point Q4 is −ΔV. In other words, at this time, the voltage at the point Q4 is VGH (the same principle as above), and the voltage of the fourth output signal Gout(n+3) is the low voltage VGL.

Figure 12:
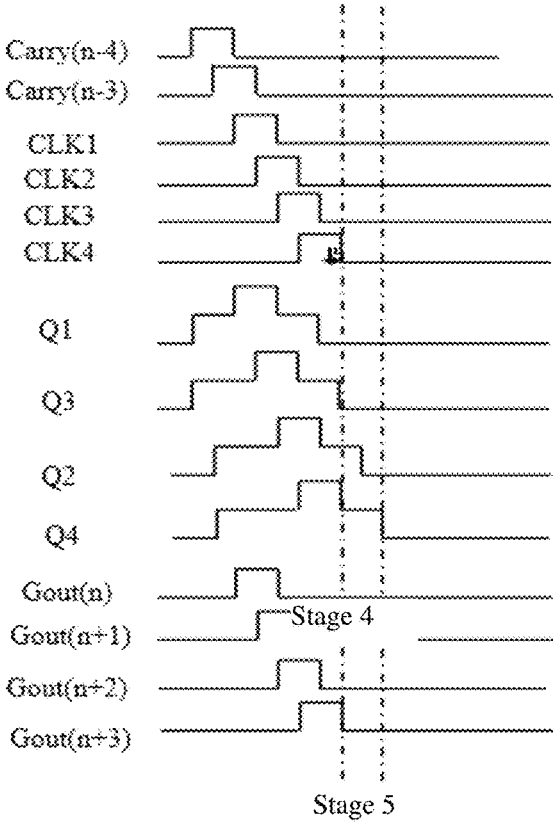
FIG. 12 is a control timing diagram of a fifth stage in the embodiment of FIG. 7.

Stage 5. As shown in FIG. 12, the voltage at the fourth point Q4 maintains to be the high voltage VGH due to the holding effect of the fourth capacitor C4, and the fourth output signal Gout(n+3) outputs the low voltage VGL because the voltage of CLK 4 is the low voltage VGL.

It should be noted that, in specific implementation, the multi-stage driving circuit may be one output unit, and the display panel may include a plurality of multi-stage driving circuits.

According to this embodiment, the control terminals of the adjacent sub-output circuits are isolated from each other through the isolation switches, so that the mutual influence between the sub-output circuits is reduced, a significant improvement is made as compared to the related art in which the voltage at the common quiescent point rises to 90 V. The deterioration of the TFT due to the high voltage is reduced. Thus, the problem of abnormal output signal caused by two stage of output circuit sharing the quiescent point is solved. In addition, since the control terminals of the adjacent sub-output circuits are connected to the output terminal of the input circuit 10 through the isolation switch respectively, and receive the control signal output by the input circuit 10 respectively, the output terminals of the sub-output circuit are connected to the pull-down circuit 20 to receive the pull-down signal respectively, In this way, an one-stage driving circuit outputting multi-stage driving signals are realized. The use of a large number of TFTs is avoided, and an area of the driving circuit board is reduced. The output signals are more stable on the basis of narrowing the frame of the display product, the users' requirements are met, and the competitiveness of the product is increased.

Figure 13:
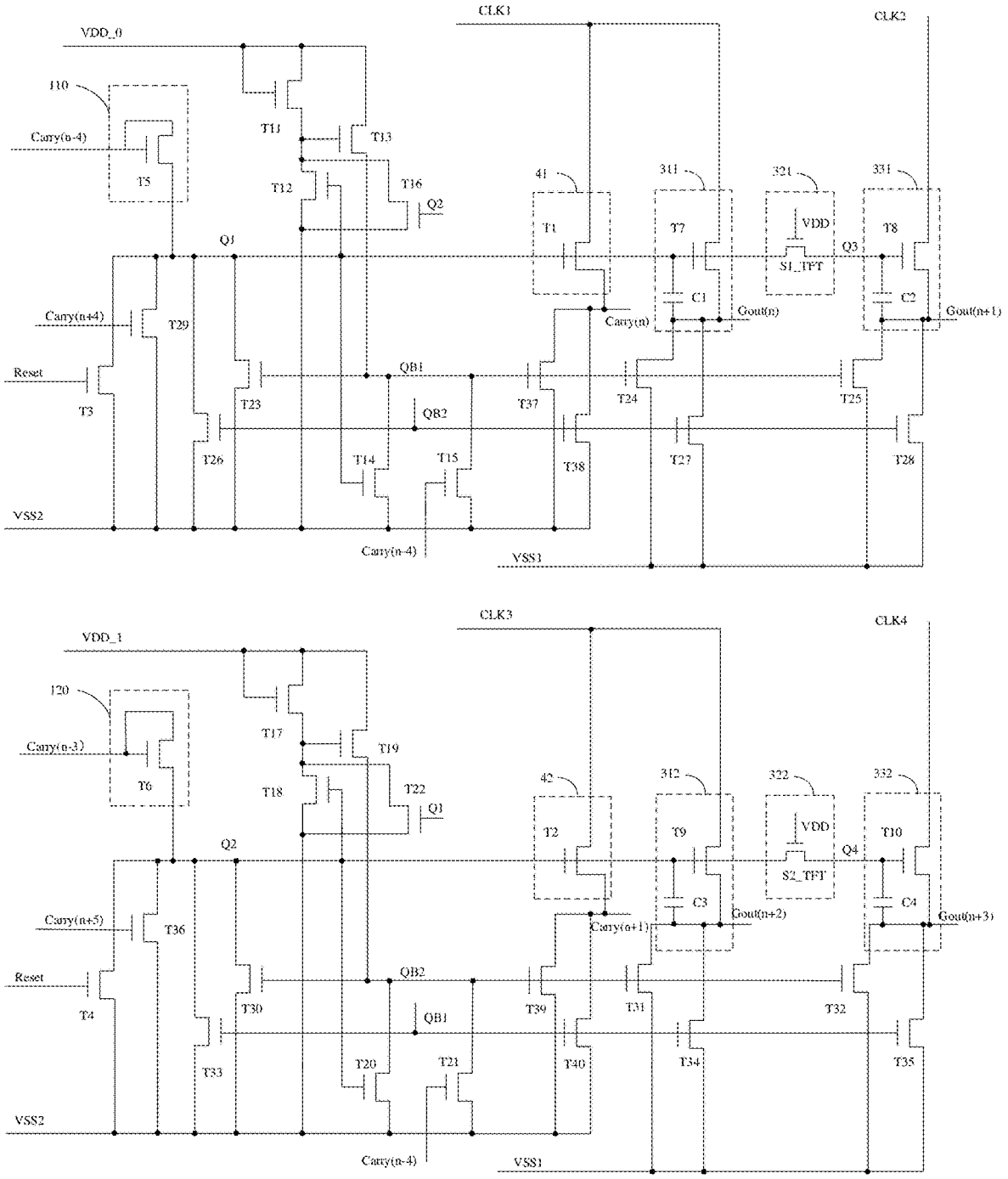
FIG. 13 is a schematic circuit diagram of the multi-stage driving circuit according to another embodiment of the present application.

Referring to FIG. 13, another embodiment of the four-stage circuit of the multi-stage driving circuit of the present application is different from the previous embodiment. In this embodiment, the first pull-down sub-circuit further includes a thirty-seventh switching transistor T37 and a thirty-eighth switching transistor T38. A control terminal of the thirty-seventh switching transistor T37 is connected to the first pull-down point QB1 and configured to receive the first pull-down signal, an input terminal of the third-seventh switching transistor T37 is connect to the output terminal of the first cascading down circuit 41, and an output terminal of the thirty-seventh switching transistor T37 is connected to the first low level voltage VSS2. A control terminal of the thirty-eighth switching transistor T38 is connected to the second pull-down point QB2 and configured to receive the second pull-down signal, and an input terminal of the thirty-eighth switching transistor T38 is connected to the output terminal of the first cascading down circuit 41, and an output terminal of the thirty-eighth switching transistor T38 is connected to the first low level voltage VSS2.

The second pull-down sub-circuit further includes a thirty-ninth switching transistor T39 and a fortieth switching transistor T40. A control terminal of the thirty-ninth switching transistor T39 is connected to the first pull-down point QB1 and configured to receive the first pull-down signal, an input terminal of the thirty-ninth switching transistor T39 is connected to the output terminal of the second cascading down circuit 42, and an output terminal of the thirty-ninth switching transistor T39 is connected to the first low level voltage VSS2. A control terminal of the fortieth switching transistor T40 is connected to the second pull-down point QB2 and configured to receive the second pull-down signal, an input terminal of the fortieth switching transistor T40 is connected to the output terminal of the second cascading down circuit 42, and an output terminal of the fortieth switching transistor T40 is connected to the first low level voltage VSS2.

In this embodiment, when the first pull-down point QB1 is at the high level, the thirty-seventh switching transistor T37 and the fortieth switching transistor T40 are turned on, and accordingly the voltage at the output terminal of the first-cascading down circuit 41 and the voltage at the output terminal of the second-cascading down circuit 42 are pulled down. When the second pull-down point QB2 is at the high level, both the thirty-eighth switching transistor T38 and the thirty-ninth switching transistor T39 are turned on, and accordingly the voltage at the output terminal of the first-cascading down circuit 41 and the voltage at the output terminal of the second-cascading down circuit 42 are pulled down. Therefore, when the first pull-down point QB1 or the second pull-down point QB2 is at the high level, the voltages of the cascading down signals are pulled down.

Figure 14:
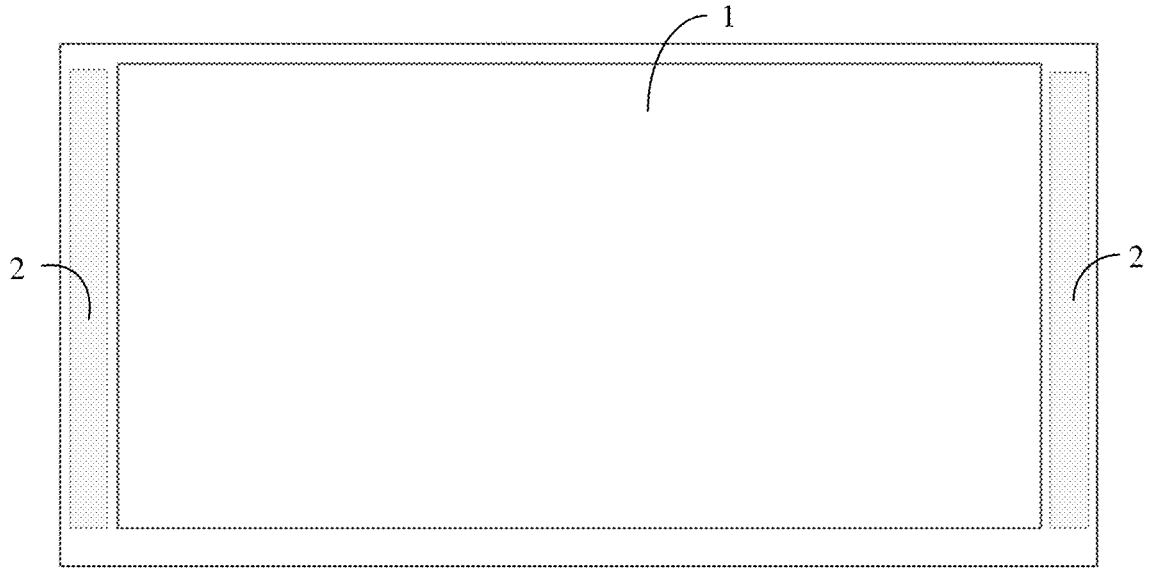
FIG. 14 is a schematic structural diagram of a display panel according to an embodiment of the present disclosure.

The present disclosure further provides a display panel. Referring to FIG. 14, in an embodiment, the display panel includes a display area 1 and a non-display area 2, the display area 1 is provided with a plurality of pixel units, and the display panel further includes: a driving circuit disposed on the non-display area 2 to output a driving signal to drive the plurality of pixel units, the driving circuit being configured as the driving circuit described above; or a multi-stage driving circuit arranged on the non-display area 2 to output a driving signal to drive the plurality of pixel units, the multi-stage driving circuit being configured as the multi-stage driving circuit described above.

The structure of the driving circuit and the structure of the multi-stage driving circuit may refer to the above embodiments, and details are not described herein again. It should be understood that, since the display panel of the present embodiment adopts the technical solutions of the above driving circuit or the above multi-stage driving circuit, the display panel has all the beneficial effects of the driving circuit or the multi-stage driving circuit, the frame of the display panel is narrowed, and the output signal of each output circuit is more stable.

The above is only an optional embodiment of the present application, and is not therefore limiting the scope of the present application. Any equivalent structural transformation made by using the contents of the specification and drawings of the present application or any direct or indirect application in other related technical fields under the inventive concept of the present application is included in the claimed scope of the present application.

What is claimed is:

1. A driving circuit, comprising:

an input circuit configured to output a control signal upon receiving a trigger signal;

an output circuit comprising at least two sub-output circuits, wherein a control terminal of a first sub-output circuit of the output circuit is connected to an output terminal of the input circuit, and control terminals of two adjacent sub-output circuits are connected by at least one isolation switch, wherein each sub-output circuit is configured to receive a corresponding input signal and output a corresponding output signal according to the control signal and the corresponding input signal;

the at least one isolation switch configured to establish a connection between the control terminals of the two adjacent sub-output circuits upon receiving a turn-on signal, and cut off the connection between the control terminals of the two adjacent sub-output circuits upon receiving a turn-off signal; and a pull-down circuit having a first terminal connected to the output terminal of the input circuit and an output terminal of each sub-output circuit, and a second terminal connected to a low level voltage, and the pull-down circuit being configured to pull down the control signal and the corresponding output signal of each sub-output circuit to a low level when a pull-down control signal is at a high level, and stop pulling down the control signal and the corresponding output signal of each sub-output circuit when the trigger signal or the control signal is at the high level;

the output circuit comprises a first sub-output circuit and a second sub-output circuit, and the isolation switch comprises a first isolation switch, a control terminal of the first sub-output circuit is connected to the output terminal of the input circuit and a control terminal of the first isolation switch, and a second terminal of the isolation switch is connected to a control terminal of the second sub-output circuit, wherein an input terminal of the first sub-output circuit is configured to receive a first input signal, and an output terminal of the first sub-output circuit is configured to output a first output signal; and wherein an input terminal of the second sub-output circuit is configured to receive a second input signal, and an output terminal of the second sub-output circuit is configured to output a second output signal;

the first isolation switch comprises an isolation switching transistor S_TFT, a control terminal of the isolation switching transistor S_TFT is configured to receive an isolation signal, an input terminal of the isolation switching transistor S_TFT is connected to the control terminal of the first sub-output circuit, and an output terminal of the isolation switching transistor S_TFT is connected to the control terminal of the second sub-output circuit.

2. The driving circuit according to claim 1, further comprising a cascading down circuit, wherein a control terminal of the cascading down circuit is connected to the output terminal of the input circuit, and configured to output a cascading down signal upon receiving a first input signal and the control signal.

3. The driving circuit according to claim 1, further comprising a reset circuit, wherein a control terminal of the reset circuit is configured to receive a reset signal, an input terminal of the reset circuit is connected to the output terminal of the input circuit, and an output terminal of the reset circuit is connected to a first low level voltage.

4. The driving circuit according to claim 1, wherein the pull-down circuit comprises a pull-down holding circuit and a pull-down sub-circuit, an input terminal of the pull-down holding circuit is connected to the output terminal of the input circuit, and the pull-down holding circuit is configured to output a pull-down signal according to the pull-down control signal; wherein a voltage of the pull-down signal is pulled down according to the trigger signal and the control signal;

a control terminal of the pull-down sub-circuit is connected to an output terminal of the pull-down holding circuit, an input terminal of the pull-down sub-circuit is connected to the output terminal of the input circuit, the output terminal of the first sub-output circuit and the output terminal of the second sub-output circuit, and an output terminal of the pull-down sub-circuit is connected to a first low level voltage, and the pull-down sub-circuit is configured to pull the first output signal of the first sub-output circuit and the second output signal of the second sub-output circuit to the low level upon receiving the pull-down signal.

5. The driving circuit according to claim 4, wherein the pull-down sub-circuit comprises a first switching transistor, a second switching transistor, and a third switching transistor, a control terminal of the first switching transistor is configured to receive the pull-down signal, an input terminal of the first switching transistor is connected to the output terminal of the input circuit, and an output terminal of the first switching transistor is connected to the first low level voltage;

a control terminal of the second switching transistor is configured to receive the pull-down signal, an input terminal of the second switching transistor is connected to the output terminal of the first sub-output circuit, and an output terminal of the second switching transistor is connected to a second low level voltage; and a control terminal of the third switching transistor is configured to receive the pull-down signal, an input terminal of the third switching transistor is connected to the output terminal of the second sub-output circuit, and an output terminal of the third switching transistor is connected to the second low level voltage.

6. The driving circuit according to claim 5, wherein the pull-down sub-circuit further comprises a fourth switching transistor, a control terminal of the fourth switching transistor is configured to receive the pull-down signal, an input terminal of the fourth switching transistor is connected to an output terminal of the cascading down circuit, and an output terminal of the fourth switching transistor is connected to the first low level voltage.

7. A multi-stage driving circuit, comprising a first driving circuit and a second driving circuit, wherein the first driving circuit comprises:

a first input circuit configured to output a first control signal upon receiving a first trigger signal;

a first output circuit comprising at least two first sub-output circuits, wherein a control terminal of a first one of the at least two first sub-output circuit of the first output circuit is connected to an output terminal of the first input circuit, and control terminals of two adjacent first sub-output circuits are connected by at least one first isolation switch, wherein each first sub-output circuit is configured to receive a corresponding input signal and output a corresponding output signal according to the control signal and the corresponding input signal;

the at least one first isolation switch configured to establish a connection between the control terminals of the two adjacent first sub-output circuits upon receiving a first turn-on signal, and cut off the connection between the control terminals of the two adjacent first sub-output circuits upon receiving a first turn-off signal;

a first pull-down circuit having a first terminal connected to the output terminal of the first input circuit and an output terminal of each first sub-output circuit, and a second terminal connected to a low level voltage, and the first pull-down circuit being configured to pull down the first control signal and the corresponding output signal of each first sub-output circuit to a low level when a first pull-down control signal is at a high level, and stop pulling down the first control signal and the corresponding output signal of each first sub-output circuit when the first trigger signal or the first control signal is at the high level;

the output circuit comprises a first sub-output circuit and a second sub-output circuit, and the isolation switch comprises a first isolation switch, a control terminal of the first sub-output circuit is connected to the output terminal of the input circuit and a control terminal of the first isolation switch, and a second terminal of the isolation switch is connected to a control terminal of the second sub-output circuit, wherein an input terminal of the first sub-output circuit is configured to receive a first input signal, and an output terminal of the first sub-output circuit is configured to output a first output signal; and wherein an input terminal of the second sub-output circuit is configured to receive a second input signal, and an output terminal of the second sub-output circuit is configured to output a second output signal;

the first isolation switch comprises an isolation switching transistor S_TFT, a control terminal of the isolation switching transistor S_TFT is configured to receive an isolation signal, an input terminal of the isolation switching transistor S_TFT is connected to the control terminal of the first sub-output circuit, and an output terminal of the isolation switching transistor S_TFT is connected to the control terminal of the second sub-output circuit; and wherein the second driving circuit comprises:

a second input circuit configured to output a second control signal upon receiving a second trigger signal;

a second output circuit comprising at least two second sub-output circuits, wherein a control terminal of a first one of the at least two second sub-output circuit of the second output circuit is connected to an output terminal of the second input circuit, and control terminals of two adjacent second sub-output circuits are connected by at least one second isolation switch, wherein each second sub-output circuit is configured to receive a corresponding input signal and output a corresponding output signal according to the control signal and the corresponding input signal;

the at least one second isolation switch configured to establish a connection between the control terminals of the two adjacent second sub-output circuits upon receiving a second turn-on signal, and cut off the connection between the control terminals of the two adjacent second sub-output circuits upon receiving a second turn-off signal; and a second pull-down circuit having a first terminal connected to the output terminal of the second input circuit and an output terminal of each second sub-output circuit, and a second terminal connected to the low level voltage, and the second pull-down circuit being configured to pull down the second control signal and the corresponding output signal of each second sub-output circuit to the low level when a second pull-down control signal is at the high level, and stop pulling down the second control signal and the corresponding output signal of each second sub-output circuit when the second trigger signal, the first control signal or the second control signal is at the high level, wherein a voltage level of the first pull-down control signal is opposite to a voltage level of the second pull-down control signal.

8. A display panel comprising a display area and a non-display area, wherein the display area is provided with a plurality of pixel units, and the display panel further comprises:

a driving circuit or a multi-stage driving circuit arranged on the non-display area to output a driving signal to drive the plurality of pixel units, wherein the driving circuit comprises:

an input circuit configured to output a control signal upon receiving a trigger signal;

an output circuit comprising at least two sub-output circuits, wherein a control terminal of a first sub-output circuit of the output circuit is connected to an output terminal of the input circuit, and control terminals of two adjacent sub-output circuits are connected by at least one isolation switch, wherein each sub-output circuit is configured to receive a corresponding input signal and output a corresponding output signal according to the control signal and the corresponding input signal;

the at least one isolation switch configured to establish a connection between the control terminals of the two adjacent sub-output circuits upon receiving a turn-on signal, and cut off the connection between the control terminals of the two adjacent sub-output circuits upon receiving a turn-off signal; and a pull-down circuit having a first terminal connected to the output terminal of the input circuit and an output terminal of each sub-output circuit, and a second terminal connected to a low level voltage, and the pull-down circuit being configured to pull down the control signal and the corresponding output signal of each sub-output circuit to a low level when a pull-down control signal is at a high level, and stop pulling down the control signal and the corresponding output signal of each sub-output circuit when the trigger signal or the control signal is at the high level;

wherein multi-stage driving circuit comprises a first driving circuit and a second driving circuit, the first driving circuit comprises:

a first input circuit configured to output a first control signal upon receiving a first trigger signal;

a first output circuit comprising at least two first sub-output circuits, wherein a control terminal of a first one of the at least two first sub-output circuit of the first output circuit is connected to an output terminal of the first input circuit, and control terminals of two adjacent first sub-output circuits are connected by at least one first isolation switch, wherein each first sub-output circuit is configured to receive a corresponding input signal and output a corresponding output signal according to the control signal and the corresponding input signal;

the at least one first isolation switch configured to establish a connection between the control terminals of the two adjacent first sub-output circuits upon receiving a first turn-on signal, and cut off the connection between the control terminals of the two adjacent first sub-output circuits upon receiving a first turn-off signal;

a first pull-down circuit having a first terminal connected to the output terminal of the first input circuit and an output terminal of each first sub-output circuit, and a second terminal connected to a low level voltage, and the first pull-down circuit being configured to pull down the first control signal and the corresponding output signal of each first sub-output circuit to a low level when a first pull-down control signal is at a high level, and stop pulling down the first control signal and the corresponding output signal of each first sub-output circuit when the first trigger signal or the first control signal is at the high level;

the output circuit comprises a first sub-output circuit and a second sub-output circuit, and the isolation switch comprises a first isolation switch, a control terminal of the first sub-output circuit is connected to the output terminal of the input circuit and a control terminal of the first isolation switch, and a second terminal of the isolation switch is connected to a control terminal of the second sub-output circuit, wherein an input terminal of the first sub-output circuit is configured to receive a first input signal, and an output terminal of the first sub-output circuit is configured to output a first output signal; and wherein an input terminal of the second sub-output circuit is configured to receive a second input signal, and an output terminal of the second sub-output circuit is configured to output a second output signal;

the first isolation switch comprises an isolation switching transistor S_TFT, a control terminal of the isolation switching transistor S_TFT is configured to receive an isolation signal, an input terminal of the isolation switching transistor S_TFT is connected to the control terminal of the first sub-output circuit, and an output terminal of the isolation switching transistor S_TFT is connected to the control terminal of the second sub-output circuit; and wherein the second driving circuit comprises:

a second input circuit configured to output a second control signal upon receiving a second trigger signal;

a second output circuit comprising at least two second sub-output circuits, wherein a control terminal of a first one of the at least two second sub-output circuit of the second output circuit is connected to an output terminal of the second input circuit, and control terminals of two adjacent second sub-output circuits are connected by at least one second isolation switch, wherein each second sub-output circuit is configured to receive a corresponding input signal and output a corresponding output signal according to the control signal and the corresponding input signal;

the at least one second isolation switch configured to establish a connection between the control terminals of the two adjacent second sub-output circuits upon receiving a second turn-on signal, and cut off the connection between the control terminals of the two adjacent second sub-output circuits upon receiving a second turn-off signal; and a second pull-down circuit having a first terminal connected to the output terminal of the second input circuit and an output terminal of each second sub-output circuit, and a second terminal connected to the low level voltage, and the second pull-down circuit being configured to pull down the second control signal and the corresponding output signal of each second sub-output circuit to the low level when a second pull-down control signal is at the high level, and stop pulling down the second control signal and the corresponding output signal of each second sub-output circuit when the second trigger signal, the first control signal or the second control signal is at the high level, wherein a voltage level of the first pull-down control signal is opposite to a voltage level of the second pull-down control signal.

9. The display panel according to claim 8, wherein the driving circuit further comprises a cascading down circuit, a control terminal of the cascading down circuit is connected to the output terminal of the input circuit, and configured to output a cascading down signal upon receiving a first input signal and the control signal.

10. The display panel according to claim 8, wherein the driving circuit further comprises a reset circuit, a control terminal of the reset circuit is configured to receive a reset signal, an input terminal of the reset circuit is connected to the output terminal of the input circuit, and an output terminal of the reset circuit is connected to a first low level voltage.

11. The display panel according to claim 8, wherein the pull-down circuit comprises a pull-down holding circuit and a pull-down sub-circuit, an input terminal of the pull-down holding circuit is connected to the output terminal of the input circuit, and the pull-down holding circuit is configured to output a pull-down signal according to the pull-down control signal; wherein a voltage of the pull-down signal is pulled down according to the trigger signal and the control signal;

a control terminal of the pull-down sub-circuit is connected to an output terminal of the pull-down holding circuit, an input terminal of the pull-down sub-circuit is connected to the output terminal of the input circuit, the output terminal of the first sub-output circuit and the output terminal of the second sub-output circuit, and an output terminal of the pull-down sub-circuit is connected to a first low level voltage, and the pull-down sub-circuit is configured to pull the first output signal of the first sub-output circuit and the second output signal of the second sub-output circuit to the low level upon receiving the pull-down signal.

12. The display panel according to claim 11, wherein the pull-down sub-circuit comprises a first switching transistor, a second switching transistor, and a third switching transistor;

a control terminal of the first switching transistor is configured to receive the pull-down signal, an input terminal of the first switching transistor is connected to the output terminal of the input circuit, and an output terminal of the first switching transistor is connected to the first low level voltage;

a control terminal of the second switching transistor is configured to receive the pull-down signal, an input terminal of the second switching transistor is connected to the output terminal of the first sub-output circuit, and an output terminal of the second switching transistor is connected to a second low level voltage; and a control terminal of the third switching transistor is configured to receive the pull-down signal, an input terminal of the third switching transistor is connected to the output terminal of the second sub-output circuit, and an output terminal of the third switching transistor is connected to the second low level voltage.

13. The display panel according to claim 12, wherein the pull-down sub-circuit further comprises a fourth switching transistor, a control terminal of the fourth switching transistor is configured to receive the pull-down signal, an input terminal of the fourth switching transistor is connected to an output terminal of the cascading down circuit, and an output terminal of the fourth switching transistor is connected to the first low level voltage.

* * * * *